US007309239B2

(12) United States Patent
Shuey et al.

(10) Patent No.: US 7,309,239 B2
(45) Date of Patent: Dec. 18, 2007

(54) HIGH-DENSITY, LOW-NOISE, HIGH-SPEED MEZZANINE CONNECTOR

(75) Inventors: Joseph B. Shuey, Camp Hill, PA (US); Stephen B. Smith, Mechanicsburg, PA (US); Clifford L. Winings, Chesterfield, MO (US); Alan Raistrick, Rockville, MD (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 11/739,013

(22) Filed: Apr. 23, 2007

(65) Prior Publication Data

US 2007/0190825 A1 Aug. 16, 2007

Related U.S. Application Data

(63) Continuation of application No. 10/917,918, filed on Aug. 13, 2004, now abandoned, which is a continuation-in-part of application No. 10/294,966, filed on Nov. 14, 2002, now Pat. No. 6,976,886, which is a continuation-in-part of application No. 09/990,794, filed on Nov. 14, 2001, now Pat. No. 6,692,272, and a continuation-in-part of application No. 10/155,786, filed on May 24, 2002, now Pat. No. 6,652,318.

(51) Int. Cl.
*H01R 12/00* (2006.01)

(52) U.S. Cl. ..... 439/74; 439/941

(58) Field of Classification Search ..... 439/74, 439/79, 108, 941, 608
See application file for complete search history.

(56) References Cited

U.S. PATENT DOCUMENTS 3,286,220 A 11/1966 Marley et al. ..... 439/680
3,538,486 A 11/1970 Shlesinger, Jr. ..... 439/268
3,669,054 A 6/1972 Desso et al. ..... 113/119
3,748,633 A 7/1973 Lundergan ..... 339/217 S
4,076,362 A 2/1978 Ichimura ..... 339/75
4,159,861 A 7/1979 Anhalt ..... 339/75
4,260,212 A 4/1981 Ritchie et al. ..... 339/97 R
4,288,139 A 9/1981 Cobaugh et al. ..... 339/74 R
4,293,827 A 10/1981 McAllister et al. ..... 439/608

(Continued)

FOREIGN PATENT DOCUMENTS

EP 0 273 683 A2 7/1988

(Continued)

OTHER PUBLICATIONS

Nadolny, J. et al., "Optimizing Connector Selection for Gigabit Signal Speeds", *ECN*™, Sep. 1, 2000, http://www.ecnmag.com/article/CA45245, 6 pages.

(Continued)

*Primary Examiner*—Ross Gushi
(74) *Attorney, Agent, or Firm*—Woodcock Washburn LLP

(57) ABSTRACT

A mezzanine style electrical connector is disclosed. The connector includes first and second arrays of electrical contacts extending through a connector housing. Each contact array may include single ended signal conductors or differential signal pairs or a combination of both. The contact arrays are disposed adjacent to one another such that cross-talk between adjacent signal contacts is limited, even in the absence of any electrical shielding or ground contacts between the contact arrays.

53 Claims, 23 Drawing Sheets

U.S. PATENT DOCUMENTS

| | | | | |
|---|---|---|---|---|
| 4,383,724 | A | 5/1983 | Verhoeven | 439/510 |
| 4,402,563 | A | 9/1983 | Sinclair | 339/75 |
| 4,560,222 | A | 12/1985 | Dambach | 339/75 |
| 4,717,360 | A | 1/1988 | Czaja | 439/710 |
| 4,776,803 | A | 10/1988 | Pretchel et al. | 439/59 |
| 4,815,987 | A | 3/1989 | Kawano et al. | 439/263 |
| 4,867,713 | A | 9/1989 | Ozu et al. | 439/833 |
| 4,907,990 | A | 3/1990 | Bertho et al. | 439/851 |
| 4,913,664 | A | 4/1990 | Dixon et al. | 439/607 |
| 4,973,271 | A | 11/1990 | Ishizuka et al. | 439/839 |
| 5,066,236 | A | 11/1991 | Broeksteeg | 439/79 |
| 5,077,893 | A | 1/1992 | Mosquera et al. | 29/882 |
| 5,163,849 | A | 11/1992 | Fogg et al. | 439/497 |
| 5,174,770 | A | 12/1992 | Sasaki et al. | 439/108 |
| 5,238,414 | A | 8/1993 | Yaegashi et al. | 439/108 |
| 5,254,012 | A | 10/1993 | Wang | 439/263 |
| 5,274,918 | A | 1/1994 | Reed | 29/882 |
| 5,277,624 | A | 1/1994 | Champion et al. | 439/607 |
| 5,286,212 | A | 2/1994 | Broeksteeg | 439/108 |
| 5,302,135 | A | 4/1994 | Lee | 439/263 |
| 5,342,211 | A | 8/1994 | Broeksteeg | 439/108 |
| 5,356,300 | A | 10/1994 | Costello et al. | 439/101 |
| 5,356,301 | A | 10/1994 | Champion et al. | 439/108 |
| 5,357,050 | A | 10/1994 | Baran et al. | 174/33 |
| 5,431,578 | A | 7/1995 | Wayne | 439/259 |
| 5,475,922 | A | 12/1995 | Tamura et al. | 29/881 |
| 5,558,542 | A | 9/1996 | O'Sullivan et al. | 439/682 |
| 5,586,914 | A | 12/1996 | Foster, Jr. et al. | 439/676 |
| 5,590,463 | A | 1/1997 | Feldman et al. | 29/844 |
| 5,609,502 | A | 3/1997 | Thumma | 439/747 |
| 5,713,746 | A | 2/1998 | Olson et al. | 439/79 |
| 5,730,609 | A | 3/1998 | Harwath | 439/108 |
| 5,741,144 | A | 4/1998 | Elco et al. | 439/101 |
| 5,741,161 | A | 4/1998 | Cahaly et al. | 439/709 |
| 5,795,191 | A | 8/1998 | Preputnick et al. | 439/608 |
| 5,817,973 | A | 10/1998 | Elco et al. | 174/32 |
| 5,853,797 | A | 12/1998 | Fuchs et al. | 427/96 |
| 5,908,333 | A | 6/1999 | Perino et al. | 439/631 |
| 5,961,355 | A | 10/1999 | Morlion et al. | 439/686 |
| 5,967,844 | A | 10/1999 | Doutrich et al. | 439/607 |
| 5,971,817 | A | 10/1999 | Longueville | 439/857 |
| 5,980,321 | A | 11/1999 | Cohen et al. | 439/608 |
| 5,993,259 | A | 11/1999 | Stokoe et al. | 439/608 |
| 6,050,862 | A | 4/2000 | Ishii | 439/843 |
| 6,068,520 | A | 5/2000 | Winings et al. | 439/676 |
| 6,116,926 | A | 9/2000 | Ortega et al. | 439/108 |
| 6,116,965 | A | 9/2000 | Arnett et al. | 439/692 |
| 6,123,554 | A | 9/2000 | Ortega et al. | 439/79 |
| 6,125,535 | A | 10/2000 | Chiou et al. | 29/883 |
| 6,129,592 | A | 10/2000 | Mickievicz et al. | 439/701 |
| 6,139,336 | A | 10/2000 | Olson | 439/83 |
| 6,146,157 | A | 11/2000 | Lenoir et al. | 439/101 |
| 6,146,203 | A | 11/2000 | Elco et al. | 439/609 |
| 6,171,115 | B1 | 1/2001 | Mickievicz et al. | 439/76.1 |
| 6,171,149 | B1 | 1/2001 | van Zanten | 439/608 |
| 6,190,213 | B1 | 2/2001 | Reichart et al. | 439/736 |
| 6,212,755 | B1 | 4/2001 | Shimada et al. | 29/527.1 |
| 6,220,893 | B1 | 4/2001 | Stephan | 439/608 |
| 6,220,896 | B1 | 4/2001 | Bertoncini et al. | 439/608 |
| 6,227,882 | B1 | 5/2001 | Ortega et al. | 439/101 |
| 6,267,604 | B1 | 7/2001 | Mickievicz et al. | 439/79 |
| 6,269,539 | B1 | 8/2001 | Takahashi et al. | 29/883 |
| 6,280,809 | B1 | 8/2001 | Wang et al. | 439/101 |
| 6,319,075 | B1 | 11/2001 | Clark et al. | 439/825 |
| 6,322,379 | B1 | 11/2001 | Ortega et al. | 439/108 |
| 6,322,393 | B1 | 11/2001 | Doutrich et al. | 439/607 |
| 6,328,602 | B1 | 12/2001 | Yamasaki et al. | 439/608 |
| 6,343,955 | B2 | 2/2002 | Billman et al. | 439/608 |
| 6,347,952 | B1 | 2/2002 | Hasegawa et al. | 439/608 |
| 6,354,877 | B1 | 3/2002 | Shuey et al. | 439/608 |
| 6,358,061 | B1 | 3/2002 | Regnier | 439/60 |
| 6,361,366 | B1 | 3/2002 | Shuey et al. | 439/608 |
| 6,363,607 | B1 | 4/2002 | Chen et al. | 29/883 |
| 6,364,710 | B1 | 4/2002 | Billman et al. | 439/608 |
| 6,371,773 | B1 | 4/2002 | Crofoot et al. | 439/79 |
| 6,375,478 | B1 | 4/2002 | Kikuchi | 439/79 |
| 6,379,188 | B1 | 4/2002 | Cohen et al. | 439/608 |
| 6,386,914 | B1 | 5/2002 | Collins et al. | 439/579 |
| 6,409,543 | B1 | 6/2002 | Astbury, Jr. et al. | 439/608 |
| 6,431,914 | B1 | 8/2002 | Billman | 439/608 |
| 6,435,914 | B1 | 8/2002 | Billman | 439/608 |
| 6,461,202 | B2 | 10/2002 | Kline | 439/701 |
| 6,471,548 | B2 | 10/2002 | Bertoncini et al. | 439/608 |
| 6,482,038 | B2 | 11/2002 | Olson | 439/608 |
| 6,485,330 | B1 | 11/2002 | Doutrich | 439/572 |
| 6,494,734 | B1 | 12/2002 | Shuey | 439/378 |
| 6,506,081 | B2 | 1/2003 | Blanchfield et al. | 439/682 |
| 6,520,803 | B1 | 2/2003 | Dunn | 439/608 |
| 6,527,587 | B1 | 3/2003 | Ortega et al. | 439/608 |
| 6,537,111 | B2 | 3/2003 | Brammer et al. | 439/857 |
| 6,540,559 | B1 | 4/2003 | Kemmick et al. | 439/608 |
| 6,547,066 | B2 | 4/2003 | Koch | 206/308.1 |
| 6,554,647 | B1 | 4/2003 | Cohen et al. | 439/607 |
| 6,572,410 | B1 | 6/2003 | Volstorf et al. | 439/608 |
| 6,652,318 | B1 | 11/2003 | Winings et al. | 439/608 |
| 6,692,272 | B2 | 2/2004 | Lemke et al. | 439/108 |
| 6,695,627 | B2 | 2/2004 | Ortega et al. | 439/78 |
| 6,764,341 | B2 | 7/2004 | Lappoehn | 439/608 |
| 6,776,649 | B2 | 8/2004 | Pape et al. | 439/485 |
| 6,808,399 | B2 | 10/2004 | Rothermel et al. | 439/108 |
| 6,843,686 | B2 | 1/2005 | Ohnishi et al. | 439/608 |
| 6,848,944 | B2 | 2/2005 | Evans | 439/608 |
| 6,851,974 | B2 | 2/2005 | Doutrich | 439/572 |
| 6,869,292 | B2 | 3/2005 | Johnescu et al. | 439/74 |
| 6,890,214 | B2 | 5/2005 | Brown et al. | 439/608 |
| 6,913,490 | B2 | 7/2005 | Whiteman, Jr. et al. | 439/608 |
| 6,932,649 | B1 | 8/2005 | Rothermel et al. | 439/620 |
| 6,945,796 | B2 | 9/2005 | Bassler et al. | 439/101 |
| 6,953,351 | B2 | 10/2005 | Fromm et al. | 439/101 |
| 6,969,280 | B2 | 11/2005 | Chien et al. | 439/608 |
| 6,981,883 | B2 | 1/2006 | Raistrick et al. | 439/74 |
| 7,097,506 | B2 | 8/2006 | Nakada | 439/608 |
| 2002/0106930 | A1 | 8/2002 | Pape et al. | 439/485 |
| 2003/0143894 | A1 | 7/2003 | Kline et al. | 439/608 |
| 2003/0220021 | A1 | 7/2003 | Kline et al. | 439/608 |
| 2005/0009402 | A1 | 1/2005 | Chien et al. | 439/608 |
| 2005/0118869 | A1 | 6/2005 | Evans | 439/608 |
| 2006/0014433 | A1 | 1/2006 | Consoli et al. | 439/608 |

FOREIGN PATENT DOCUMENTS

| | | |
|---|---|---|
| EP | 0 891 016 | 10/2002 |
| EP | 1 148 587 B1 | 4/2005 |
| JP | 06-236788 | 8/1994 |
| JP | 07-114958 | 5/1995 |
| JP | 11/185886 | 7/1999 |
| JP | 2000-003743 | 1/2000 |
| JP | 2000-003744 | 1/2000 |
| JP | 2000-003745 | 1/2000 |
| JP | 2000-003746 | 1/2000 |
| WO | WO 01/29931 A1 | 4/2001 |
| WO | WO 01/39332 A1 | 5/2001 |

OTHER PUBLICATIONS

"PCB-Mounted Receptacle Assemblies, 2.00mm(0.079in) Centerlines, Right-Angle Solder-to-Board Signal Receptacle", *Metral*™, Berg Electronics, 10-6-10-7, 2 pages.

*Metral*™, "Speed & Density Extensions", *FCI*, Jun. 3, 1999, 25 pages.

Framatome Connector Specification, 1 page.

MILLIPACS Connector Type A Specification, 1 page.

Fusi, M.A. et al., "Differential Signal Transmission through Backplanes and Connectors", *Electronic Packaging and Production*, Mar. 1996, 27-31.

Goel, R.P. et al., "AMP Z-Pack Interconnect System", 1990, AMP Incorporated, 9 pages.
"FCI's Airmax VS® Connector System Honored at DesignCon", 2005, Heilind Electronics, Inc., http://www.heilind.com/products/fci/airmax-vs-design.asp, 1 page.
Hult, B., "FCI's Problem Solving Approach Changes Market, The FCI Electronics AirMax VS®", connector Supplier.com, Http://www.connectorsupplier.com/tech_updates_FCI-airmax_archive.htm, 2006, 4 pages.
Backplane Products Overview Page, http://www.molex.com/cgi-bin/bv/molex/super_family/super_family.jsp?BV_Session ID=@, 2005-2006© Molex, 4 pages.
AMP Z-Pack 2mm HM Interconnection System, 1992 and 1994© by AMP Incorporated, 6 pages.
Metral® 2mm High-Speed Connectors, 1000, 2000, 3000 Series, Electrical Performance Data for Differential Applications, FCI Framatome Group, 2 pages.
HDM® HDM Plus® Connectors, http://www.teradyne.com/prods/tcs/products/connectors/backplane/hdm/index.html, 2006, 1 page.
Amphenol TCS (ATCS):HDM® Stacker Signal Integrity, http://www.teradyne.com/prods/tcs/products/connectors/mezzanine/hdm_stacker/signintegr, 3 pages.
Amphenol TCS (ATCS): VHDM Connector, http://www.teradyne.com/prodc/tcs/products/connectors/backplane/vhdm/index.html, 2 pages.
VHDM High-Speed Differential (VHDM HSD), http://www.teradyne.com/prods/bps/vhdm/hsd.html, 6 pages.
Amphenol TCS(ATCS): VHDM L-Series Connector, http://www.teradyne.com/prods/tcs/products/connectors/backplane/vhdm_1-series/index.html, 2006, 4 pages.
VHDM Daughterboard Connectors Feature press-fit Terminations and a Non-Stubbing Seperable Interface, © Teradyne, Inc. Connections Systems Division, Oct. 8, 1997, 46 pages.
HDM/HDM *plus*, 2mm Backplane Interconnection system, Teradyne Connection Systems, © 1993, 22 pages.
HDM Separable Interface Detail, Molex®, 3 pages.
"Lucent Technologies' Bell Labs and FCI Demonstrate 25gb/S Data Transmission over Electrical Backplane Connectors", Feb. 1, 2005, http://www.lucent.com/press/0205/050201.bla.html, 4 pages.
"B.? Bandwidth and Rise Time Budgets", Module 1-8. Fiber Optic Telecommunications (E-XVI-2a), http://cord.org/step_online/st1-8/st18exvi2a.htm, 3 pages.
"Tyco Electronics, Z-Dok and Connector", Tyco Electronics, Jun. 23, 2003, http://2dok.tyco.elcetronics.com, 15 pages.
Tyco Electronics/AMP, "Z-Dok and Z-Dok and Connectors", Application Specification # 114-13068, Aug. 30, 2005, Revision A, 16 pages.
Tyco Electronics, "Champ Z-Dok Connector System", Catalog # 1309281, Issued Jan. 2002, 3 pages.
GIG-ARRAY ® High Speed Mezzanine Connectors 15-40 mm Board to Board, Jun. 5, 2006, 1 page.
Communications, Data, Consumer Division Mezzanine High-Speed High-Density Connectors GIG-ARRAY® and MEG-ARRAY® electrical Performance Data, 10 pages FCI Corporation.
AMP Z-Pack 2mm HM Connector, 2mm Centerline, Eight-Row, Right-Angle Applications, Electrical Performance Report, EPR 889065, Issued Sep. 1998, 59 pages.
AMP Z-Pack HM-Zd Performance at Gigabit Speeds, Tyco Electronics, Report #20GC014, Rev.B., May 4, 2001, 30 pages.
Honda Connectors, "Honda High-Speed Backplane Connector NSP Series", Honda Tsushin Kogoyo Co., Ltd., Development Engineering Division, Tokyo, Japan, Feb. 7, 2003, 25 pages.
NSP, Honda The World Famous Connectors, http://www.honda-connectors.co.jp, 6 pages, English Language Translation attached.
U.S. Appl. No. 11/052,167, filed Feb. 7, 2005, Shuey, et al.

HIGH-DENSITY, LOW-NOISE, HIGH-SPEED MEZZANINE CONNECTOR

CROSS-REFERENCE TO RELATED APPLICATIONS

This application is a continuation of U.S. patent application Ser. No. 10/917,918, filed Aug. 13, 2004 now abandoned, which is a continuation-in-part of U.S. patent application Ser. No. 10/294,966, filed Nov. 14, 2002, now U.S. Pat. No. 6,976,886, which is a continuation-in-part of U.S. patent applications Ser. No. 09/990,794, filed Nov. 14, 2001, now U.S. Pat. No. 6,692,272, and Ser. No. 10/155,786, filed May 24, 2002, now U.S. Pat. No. 6,652,318. The contents of each of the above-referenced U.S. patents and patent applications is herein incorporated by reference in its entirety.

FIELD OF THE INVENTION

Generally, the invention relates to the field of electrical connectors. More particularly, the invention relates to lightweight, low cost, high density mezzanine-style electrical connectors that provide impedance controlled, high-speed, low interference communications, even in the absence of shields between the contacts, and that provide for a variety of other benefits not found in prior art connectors.

BACKGROUND OF THE INVENTION

Electrical connectors provide signal connections between electronic devices using signal contacts. Often, the signal contacts are so closely spaced that undesirable interference, or "cross talk," occurs between adjacent signal contacts. As used herein, the term "adjacent" refers to contacts (or rows or columns) that are next to one another. Cross talk occurs when one signal contact induces electrical interference in an adjacent signal contact due to intermingling electrical fields, thereby compromising signal integrity. With electronic device miniaturization and high speed, high signal integrity electronic communications becoming more prevalent, the reduction of cross talk becomes a significant factor in connector design.

One commonly used technique for reducing cross talk is to position separate electrical shields, in the form of metallic plates, for example, between adjacent signal contacts. The shields act to block cross talk between the signal contacts by blocking the intermingling of the contacts' electric fields. Ground contacts are also frequently used to block cross talk between adjacent differential signal pairs. FIGS. 1A and 1B depict exemplary contact arrangements for electrical connectors that use shields and ground contacts to block cross talk.

FIG. 1A depicts an arrangement in which signal contacts (designated as either $S^+$ or $S^-$) and ground contacts G are arranged such that differential signal pairs S+, S− are positioned along columns 101-106. As shown, shields 112 can be positioned between contact columns 101-106. A column 101-106 can include any combination of signal contacts S+, S− and ground contacts G. The ground contacts G serve to block cross talk between differential signal pairs in the same columns The shields 112 serve to block cross talk between differential signal pairs in adjacent columns.

FIG. 1B depicts an arrangement in which signal contacts S and ground contacts G are arranged such that differential signal pairs S+, S− are positioned along rows 111-116. As shown, shields 122 can be positioned between rows 111-116. A row 111-116 can include any combination of signal contacts S+, S− and ground contacts G. The ground contacts G serve to block cross talk between differential signal pairs in the same row. The shields 122 serve to block cross talk between differential signal pairs in adjacent rows.

Because of the demand for smaller, lower weight communications equipment, it is desirable that connectors be made smaller and lower in weight, while providing the same performance characteristics. Shields take up valuable space within the connector that could otherwise be used to provide additional signal contacts, and thus limit contact density (and, therefore, connector size). Additionally, manufacturing and inserting such shields substantially increase the overall costs associated with manufacturing such connectors. In some applications, shields are known to make up 40% or more of the cost of the connector. Another known disadvantage of shields is that they lower impedance. Thus, to make the impedance high enough in a high contact density connector, the contacts would need to be so small that they would not be robust enough for many applications.

U.S. patent application Ser. No. 10/284,966, the disclosure of which is incorporated by reference in its entirety, discloses and claims lightweight, low cost, high density electrical connectors that provide impedance controlled, high-speed, low interference communications, even in the absence of shields between the contacts. It would be desirable, however, if there existed a lightweight, high-speed, mezzanine-style, electrical connector (i.e., one that operates above 1 Gb/s and typically in the range of about 10 Gb/s) that reduces the occurrence of cross talk without the need for ground contacts or internal shields.

SUMMARY OF THE INVENTION

The invention provides high speed mezzanine connectors (operating above 1 Gb/s and typically in the range of about 10-20 Gb/s) wherein signal contacts are arranged so as to limit the level of cross talk between adjacent differential signal pairs. Such a connector can include signal contacts that form impedance-matched differential signal pairs along rows or columns. The connector can be, and preferably is, devoid of internal shields and ground contacts. The contacts maybe dimensioned and arranged relative to one another such that a differential signal in a first signal pair produces a high field in a gap between the contacts that form the signal pair, and a low field near adjacent signal pairs. Air may be used as a primary dielectric to insulate the contacts and thereby provide a low-weight connector that is suitable for use as a mezzanine connector.

Such connectors also include novel contact configurations for reducing insertion loss and maintaining substantially constant impedance along the lengths of contacts. The use of air as the primary dielectric to insulate the contacts results in a lower weight connector that is suitable for use as a mezzanine style ball grid array connector.

BRIEF DESCRIPTION OF THE DRAWINGS

The invention is further described in the detailed description that follows, by reference to the noted drawings by way of non-limiting illustrative embodiments of the invention, in which like reference numerals represent similar parts throughout the drawings, and wherein:

FIG. 2D is a graph illustrating the relationship between multi-active cross talk and offset between adjacent columns of terminals in accordance with one aspect of the invention;

DETAILED DESCRIPTION OF ILLUSTRATIVE EMBODIMENTS

Certain terminology may be used in the following description for convenience only and should not be considered as limiting the invention in any way. For example, the terms "top," "bottom," "left," "right," "upper," and "lower" designate directions in the figures to which reference is made. Likewise, the terms "inwardly" and "outwardly" designate directions toward and away from, respectively, the geometric center of the referenced object. The terminology includes the words above specifically mentioned, derivatives thereof, and words of similar import.

I-Shaped Geometry for Electrical Connectors—Theoretical Model

Figure 1A:
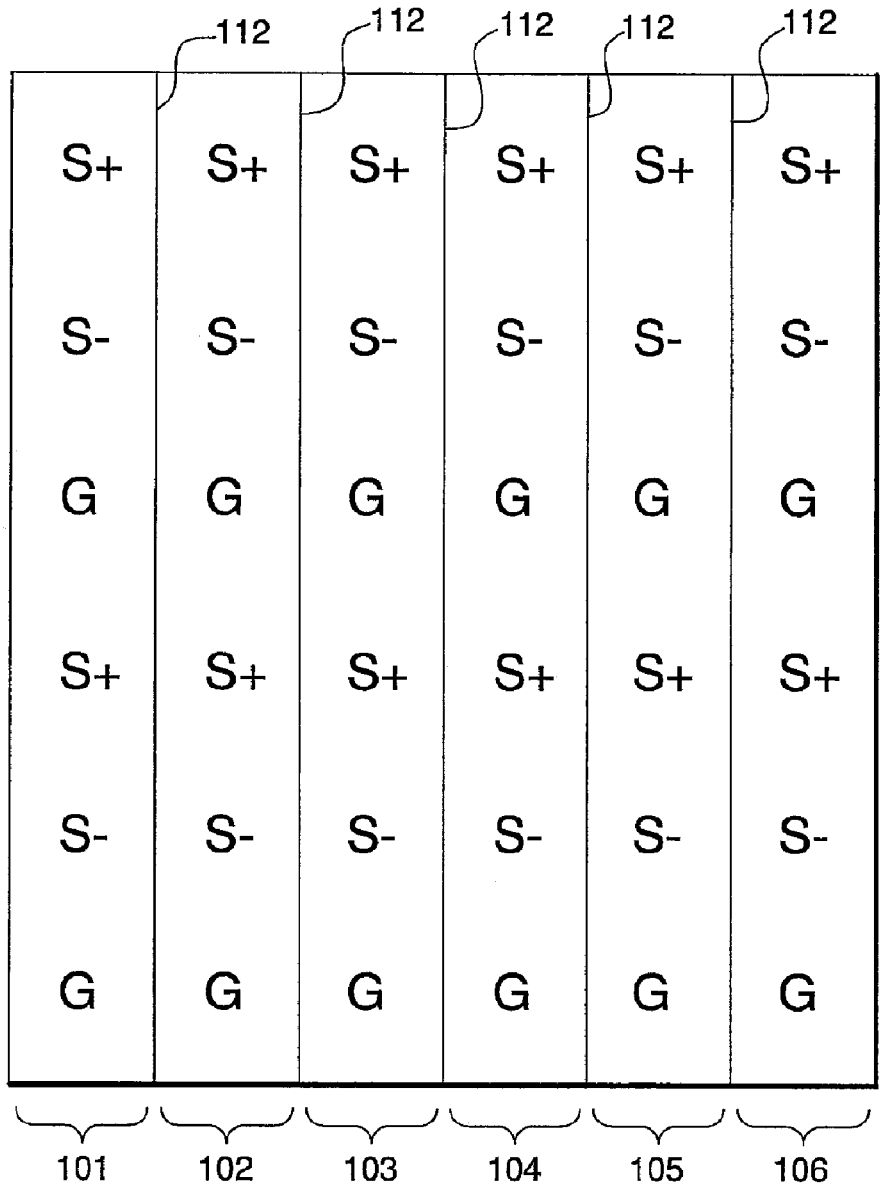
FIG. 1A (PRIOR ART)
FIGS. 1A and 1B depict exemplary contact arrangements for electrical connectors in the prior art that use shields to block cross talk.
Figure 1B:
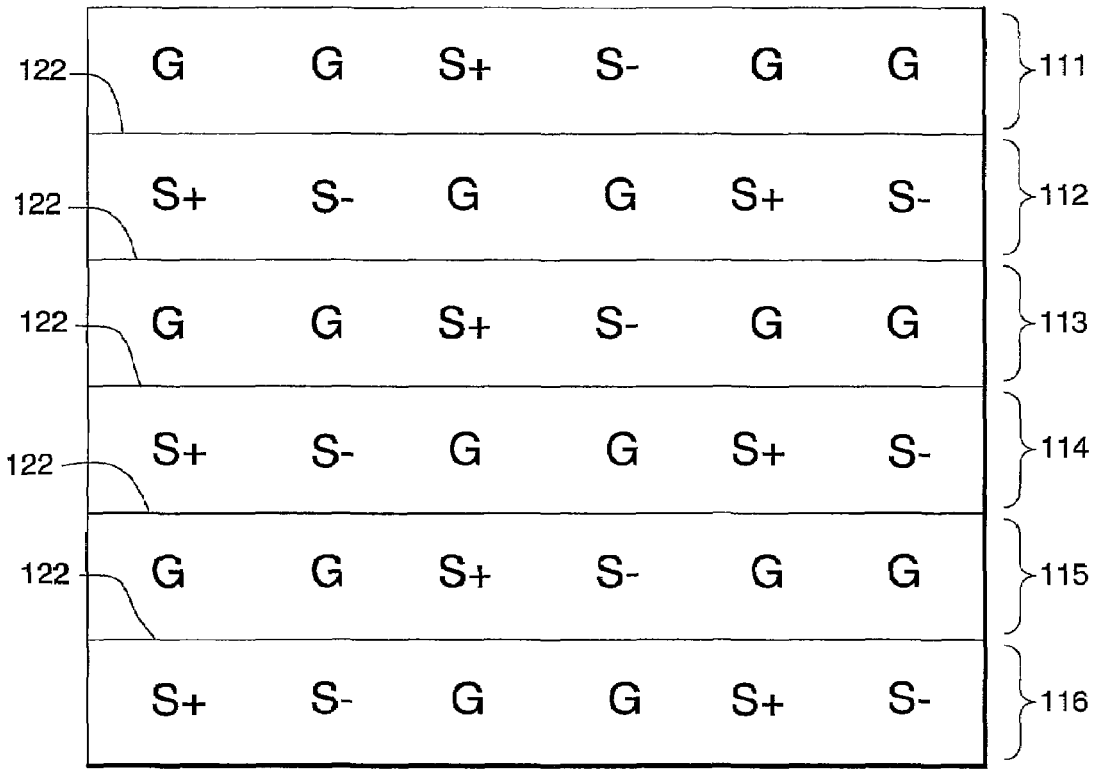
FIG. 1B (PRIOR ART)
Figure 2A:
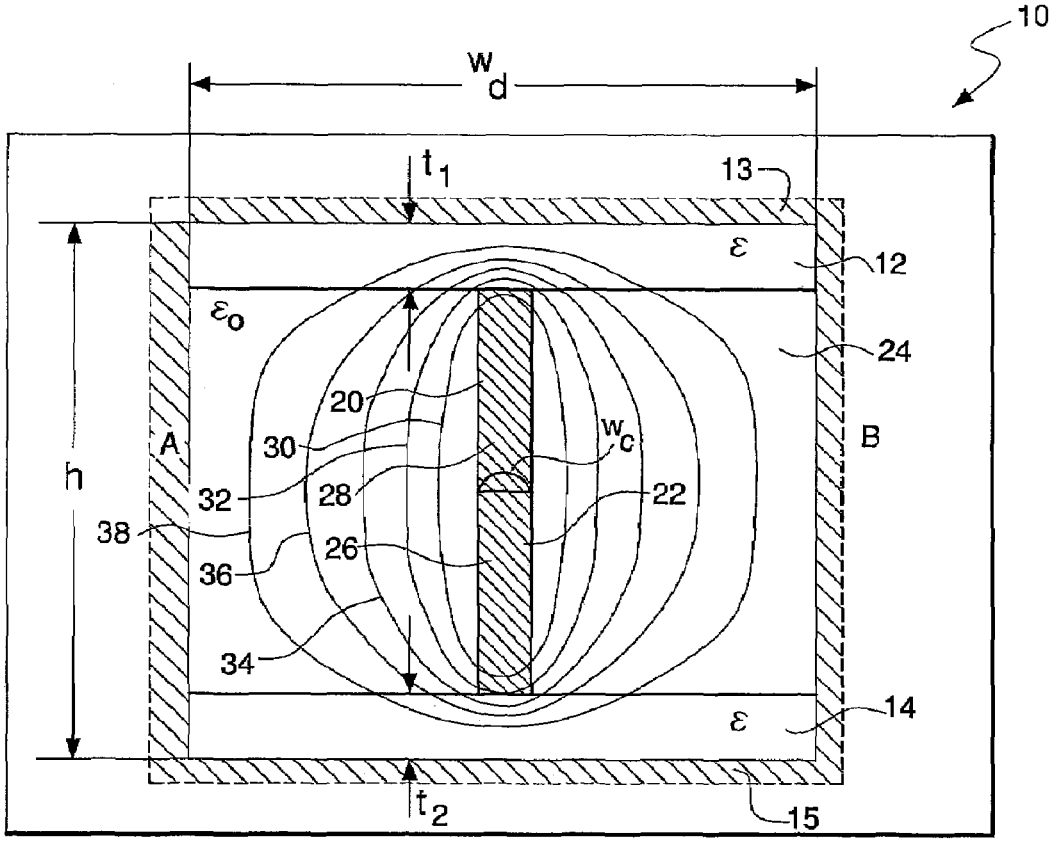
FIG. 2A (PRIOR ART)
FIG. 2A is a schematic illustration of an electrical connector in the prior art in which conductive and dielectric elements are arranged in a generally "I" shaped geometry.

FIG. 2A is a schematic illustration of an electrical connector in which conductive and dielectric elements are arranged in a generally "I" shaped geometry. Such connectors are embodied in the assignee's "I-BEAM" technology, and are described and claimed in U.S. Pat. No. 5,741,144, entitled "Low Cross And Impedance Controlled Electric Connector," the disclosure of which is hereby incorporated herein by reference in its entirety. Low cross talk and controlled impedance have been found to result from the use of this geometry.

The originally contemplated I-shaped transmission line geometry is shown in FIG. 2A. As shown, the conductive element can be perpendicularly interposed between two parallel dielectric and ground plane elements. The description of this transmission line geometry as I-shaped comes from the vertical arrangement of the signal conductor shown generally at numeral 10 between the two horizontal dielectric layers 12 and 14 having a permitivity $\epsilon$ and ground planes 13 and 15 symmetrically placed at the top and bottom edges of the conductor. The sides 20 and 22 of the conductor are open to the air 24 having an air permitivity $\epsilon_0$. In a connector application, the conductor could include two sections, 26 and 28, that abut end-to-end or face-to-face. The thickness, $t_1$ and $t_2$ of the dielectric layers 12 and 14, to first order, controls the characteristic impedance of the transmission line and the ratio of the overall height h to dielectric width $w_d$ controls the electric and magnetic field penetration to an adjacent contact. Original experimentation led to the conclusion that the ratio $h/w_d$ needed to minimize interference beyond A and B would be approximately unity (as illustrated in FIG. 2A).

The lines 30, 32, 34, 36 and 38 in FIG. 2A are equipotentials of voltage in the air-dielectric space. Taking an equipotential line close to one of the ground planes and following it out towards the boundaries A and B, it will be seen that both boundary A or boundary B are very close to the ground potential. This means that virtual ground surfaces exist at each of boundary A and boundary B. Therefore, if two or more I-shaped modules are placed side-by-side, a virtual ground surface exists between the modules and there will be little to no intermingling of the modules' fields. In general, the conductor width $w_c$ and dielectric thicknesses $t_1$, $t_2$ should be small compared to the dielectric width $w_d$ or module pitch (i.e., distance between adjacent modules).

Given the mechanical constraints on a practical connector design, it was found in actuality that the proportioning of the signal conductor (blade/beam contact) width and dielectric thicknesses could deviate somewhat from the preferred ratios and some minimal interference might exist between adjacent signal conductors. However, designs using the above-described I-shaped geometry tend to have lower cross talk than other conventional designs.

Exemplary Factors Affecting Cross Talk Between Adjacent Contacts

Figure 2B:
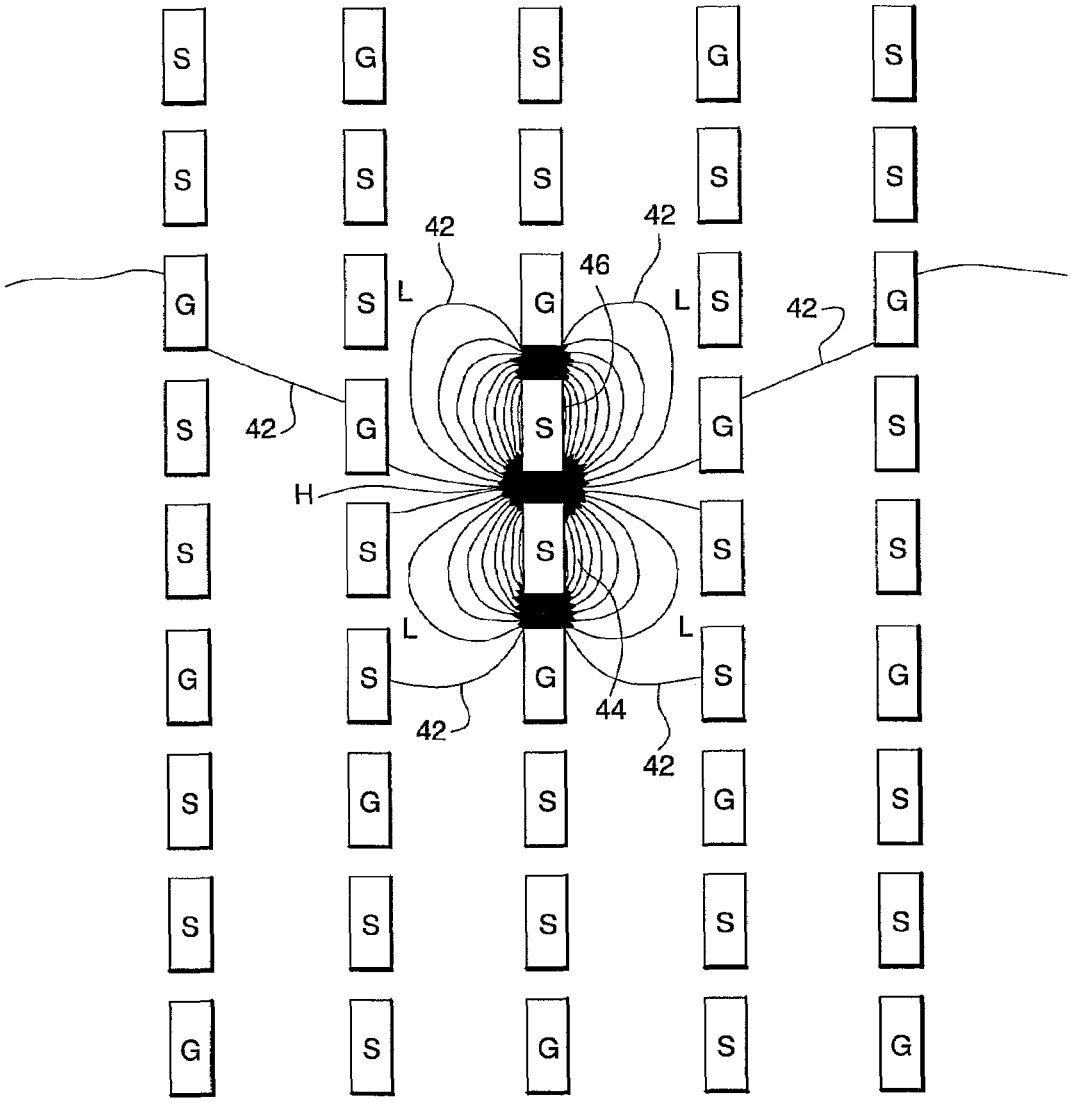
FIG. 2B depicts equipotential regions within an arrangement of signal and ground contacts.

In accordance with the invention, the basic principles described above were further analyzed and expanded upon and can be employed to determine how to even further limit cross talk between adjacent signal contacts, even in the absence of shields between the contacts, by determining an appropriate arrangement and geometry of the signal and ground contacts. FIG. 2B includes a contour plot of voltage in the neighborhood of an active column-based differential signal pair S+, S− in a contact arrangement of signal contacts S and ground contacts G according to the invention. As shown, contour lines 42 are closest to zero volts, contour lines 44 are closest to −1 volt, and contour lines 46 are closest to +1 volt. It has been observed that, although the voltage does not necessarily go to zero at the "quiet"

differential signal pairs that are nearest to the active pair, the interference with the quiet pairs is near zero. That is, the voltage impinging on the positive-going quiet differential pair signal contact is about the same as the voltage impinging on the negative-going quiet differential pair signal contact. Consequently, the noise on the quiet pair, which is the difference in voltage between the positive- and negative-going signals, is close to zero.

Thus, as shown in FIG. 2B, the signal contacts S and ground contacts G can be scaled and positioned relative to one another such that a differential signal in a first differential signal pair produces a high field H in the gap between the contacts that form the signal pair and a low (i.e., close to ground potential) field L (close to ground potential) near an adjacent signal pair. Consequently, cross talk between adjacent signal contacts can be limited to acceptable levels for the particular application. It is well-known that worst case, multi-active cross-talk of 6% or less is acceptable. In such connectors, the level of cross talk between adjacent signal contacts can be limited to the point that the need for (and cost of) shields between adjacent contacts is unnecessary, even in high speed, high signal integrity applications.

Through further analysis of the above-described I-shaped model, it has been found that the unity ratio of height to width is not as critical as it first seemed. It has also been found that a number of factors can affect the level of cross talk between adjacent signal contacts. A number of such factors are described in detail below, though it is anticipated that there may be others. Additionally, though it is preferred that all of these factors be considered, it should be understood that each factor may, alone, sufficiently limit cross talk for a particular application. Any or all of the following factors may be considered in determining a suitable contact arrangement for a particular connector design:

a) Less cross talk has been found to occur where adjacent contacts are edge-coupled (i.e., where the edge of one contact is adjacent to the edge of an adjacent contact) than where adjacent contacts are broad side coupled (i.e., where the broad side of one contact is adjacent to the broad side of an adjacent contact) or where the edge of one contact is adjacent to the broad side of an adjacent contact. The tighter the edge coupling, the less the coupled signal pair's electrical field will extend towards an adjacent pair and the less the towards the unity height-to-width ratio of the original I-shaped theoretical model a connector application will have to approach. Edge coupling also allows for smaller gap widths between adjacent connectors, and thus facilitates the achievement of desirable impedance levels in high contact density connectors without the need for contacts that are too small to perform adequately. For example, it has been found than a gap of about 0.3-0.4 mm is adequate to provide an impedance of about 100 ohms where the contacts are edge coupled, while a gap of about 1 mm is necessary where the same contacts are broad side coupled to achieve the same impedance. Edge coupling also facilitates changing contact width, and therefore gap width, as the contact extends through dielectric regions, contact regions, etc.;

b) It has also been found that cross talk can be effectively reduced by varying the "aspect ratio," i.e., the ratio of column pitch (i.e., the distance between adjacent columns) to the gap between adjacent contacts in a given column;

c) The "staggering" of adjacent columns relative to one another can also reduce the level of cross talk. That is, cross talk can be effectively limited where the signal contacts in a first column are offset relative to adjacent signal contacts in an adjacent column. The amount of offset may be, for example, a full row pitch (i.e., distance between adjacent rows), half a row pitch, or any other distance that results in acceptably low levels of cross talk for a particular connector design. It has been found that the optimal offset depends on a number of factors, such as column pitch, row pitch, the shape of the terminals, and the dielectric constant(s) of the insulating material(s) around the terminals, for example. It has also been found that the optimal offset is not necessarily "on pitch," as was often thought. That is, the optimal offset may be anywhere along a continuum, and is not limited to whole fractions of a row pitch (e.g., full or half row pitches).

Figure 2C:
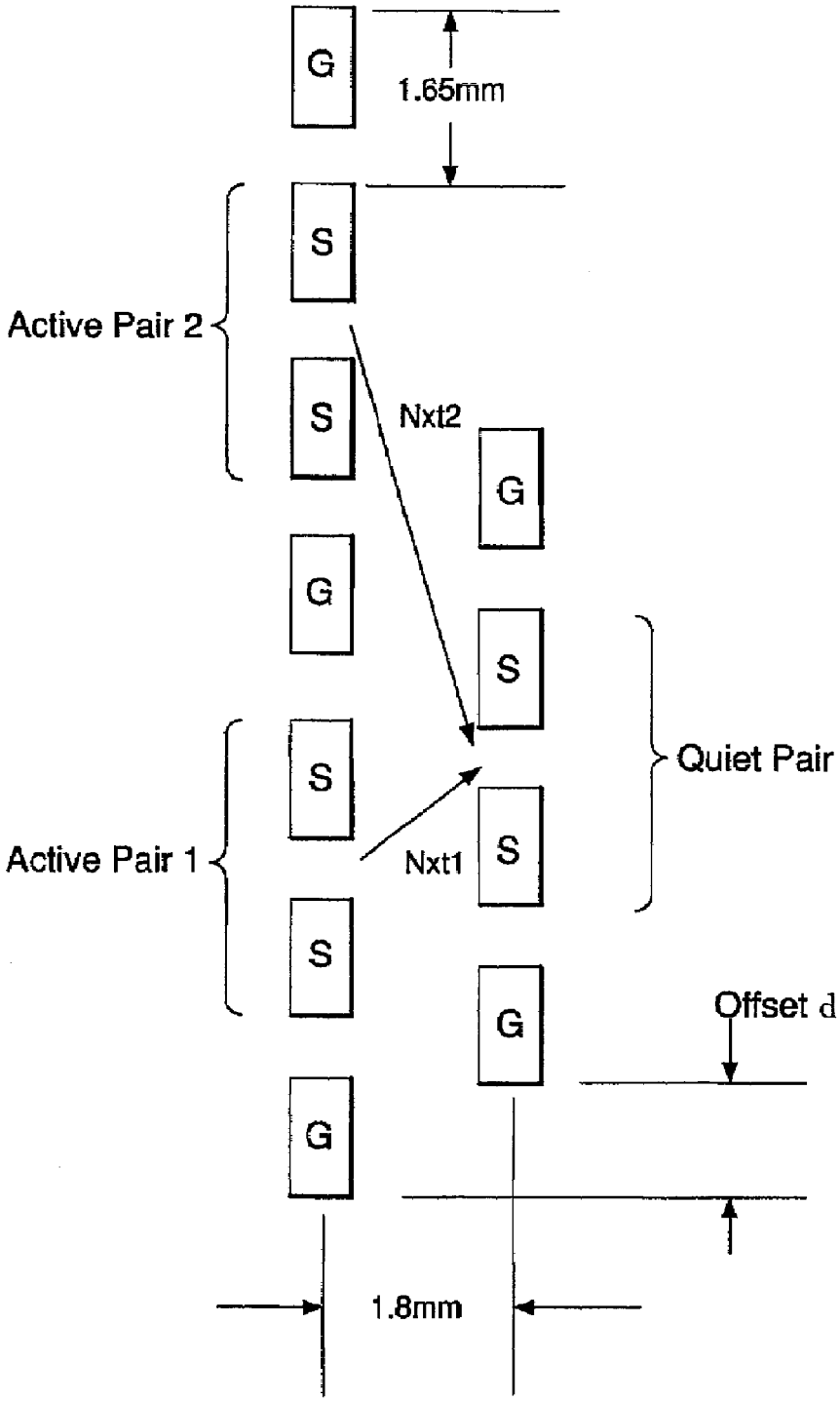
FIG. 2C illustrates a conductor arrangement used to measure the effect of offset on multi-active cross talk.
Figure 20:
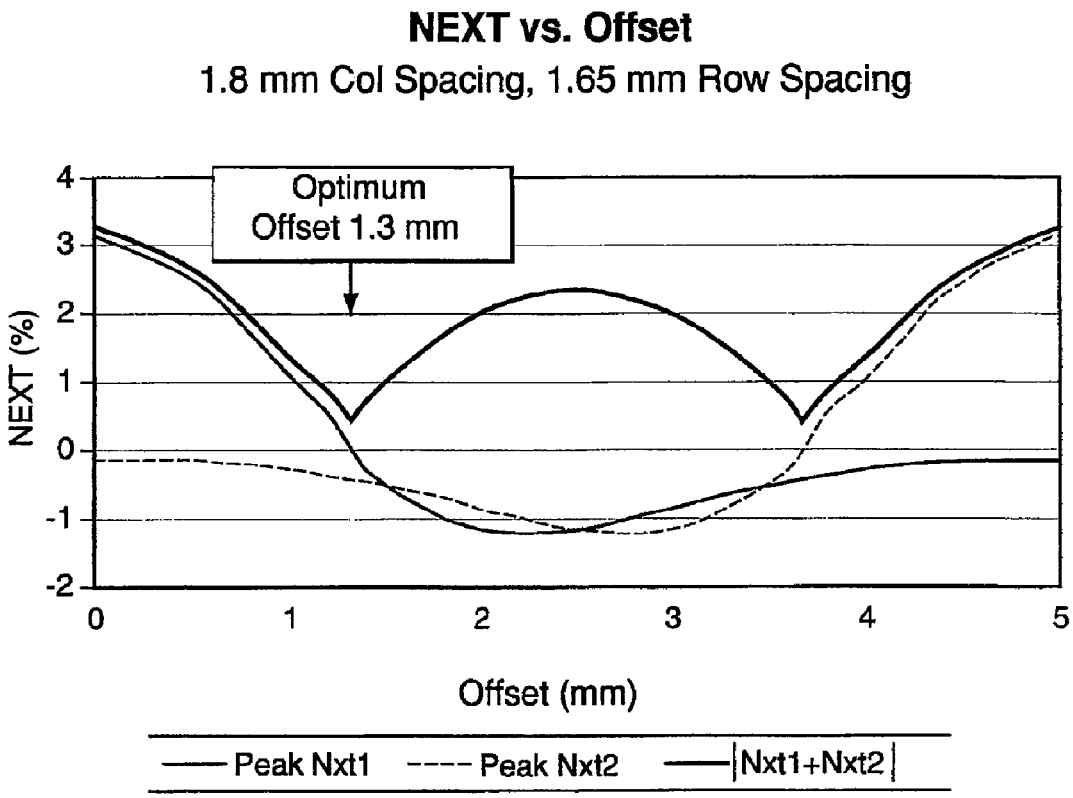

FIG. 2C illustrates a contact arrangement that has been used to measure the effect of offset between adjacent columns on cross talk. Fast (e.g., 40 ps) rise-time differential signals were applied to each of Active Pair 1 and Active Pair 2. Near-end crosstalk Nxt1 and Nxt2 were determined at Quiet Pair, to which no signal was applied, as the offset d between adjacent columns was varied from 0 to 5.0 mm. Near-end cross talk occurs when noise is induced on the quiet pair from the current carrying contacts in an active pair.

As shown in the graph of FIG. 2D, the incidence of multi-active cross talk (dark line in FIG. 2D) is minimized at offsets of about 1.3 mm and about 3.65 mm. In this experiment, multi-active cross talk was considered to be the sum of the absolute values of cross talk from each of Active Pair 1 (dashed line in FIG. 2D) and Active Pair 2 (thin solid line in FIG. 2D). Thus, it has been shown that adjacent columns can be variably offset relative to one another until an optimum level of cross talk between adjacent pairs (about 1.3 mm, in this example);

d) Through the addition of outer grounds, i.e., the placement of ground contacts at alternating ends of adjacent contact columns, both near-end cross talk ("NEXT") and far-end cross talk ("FEXT") can be further reduced;

e) It has also been found that scaling the contacts (i.e., reducing the absolute dimensions of the contacts while preserving their proportional and geometric relationship) provides for increased contact density (i.e., the number of contacts per linear inch) without adversely affecting the electrical characteristics of the connector.

By considering any or all of these factors, a connector can be designed that delivers high-performance (i.e., acceptable level of cross talk, e.g., less than 6% worse-case multi-active), high-speed communications (e.g., at data transfer rates greater than 1 Gb/s and typically about 10 Gb/s, i.e., signals with rise times of 40-200 ps) even in the absence of shields between adjacent contacts. It should also be understood that such connectors and techniques, which are capable of providing such high speed communications, are also useful at lower speeds. Connectors according to the invention have been shown, in worst case testing scenarios, to have near-end cross talk of less than about 3% and far-end cross talk of less than about 4%, at 40 picosecond rise time, with 63.5 mated signal pairs per linear inch. Such connectors can have insertion losses of less than about 0.7 dB at 5 GHz, and impedance match of about 100±8 ohms measured at a 40 picosecond rise time.

Figure 2E:
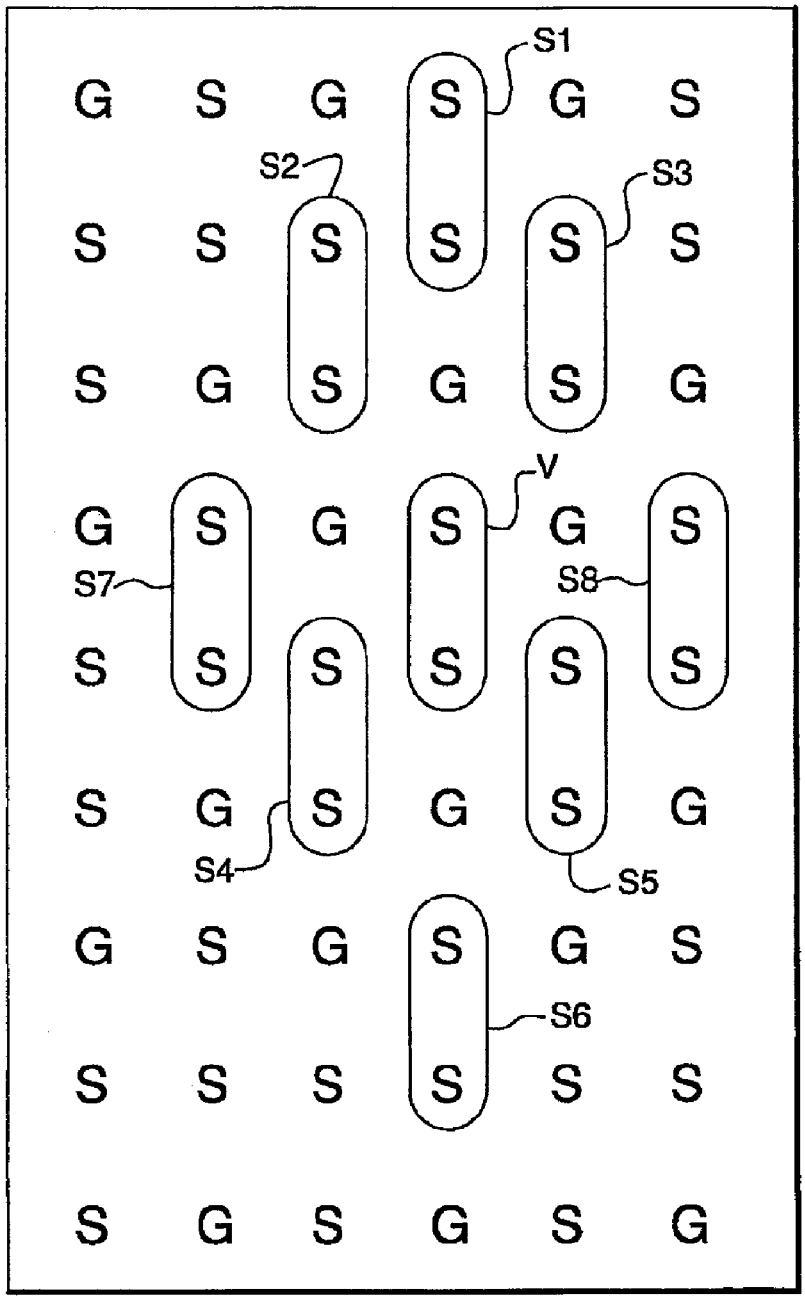
FIG. 2E depicts a contact arrangement for which cross talk was determined in a worst case scenario.

FIG. 2E depicts a contact arrangement for which cross talk was determined in a worst case scenario. Cross talk from each of six attacking pairs S1, S2, S3, S4, S5, and S6 was determined at a "victim" pair V. Attacking pairs S1, S2, S3, S4, S5, and S6 are six of the eight nearest neighboring pairs to signal pair V. It has been determined that the additional affects on cross talk at victim pair V from attacking pairs S7 and S8 is negligible. The combined cross talk from the six nearest neighbor attacking pairs has been determined by summing the absolute values of the peak cross talk from each of the pairs, which assumes that each pair is fairing at the highest level all at the same time. Thus, it should be understood that this is a worst case scenario, and that, in practice, much better results should be achieved.

Exemplary Contact Arrangements According to the Invention

Figure 3A:
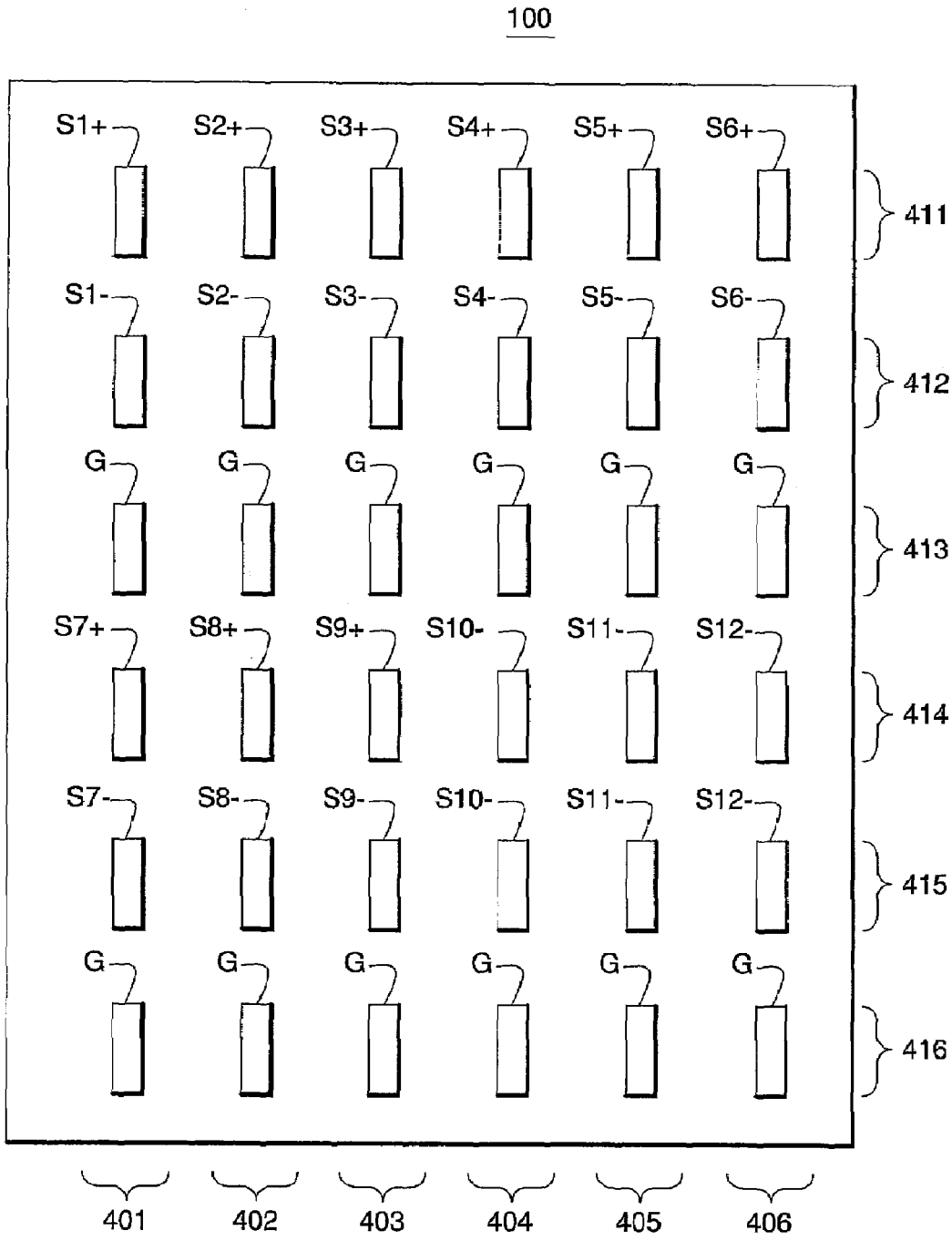
FIGS. 3A-3C depict conductor arrangements in which signal pairs are arranged in columns.

FIG. 3A depicts a connector 100 according to the invention having column-based differential signal pairs (i.e., in which differential signal pairs are arranged into columns). (As used herein, a "column" refers to the direction along which the contacts are edge coupled. A "row" is perpendicular to a column.) As shown, each column 401-406 comprises, in order from top to bottom, a first differential signal pair, a first ground conductor, a second differential signal pair, and a second ground conductor. As can be seen, first column 401 comprises, in order from top to bottom, a first differential signal pair comprising signal conductors S1+ and S1−, a first ground conductor G, a second differential signal pair comprising signal conductors S7+ and S7−, and a second ground conductor G. Each of rows 413 and 416 comprises a plurality of ground conductors G. Rows 411 and 412 together comprise six differential signal pairs, and rows 514 and 515 together comprise another six differential signal pairs. The rows 413 and 416 of ground conductors limit cross talk between the signal pairs in rows 411-412 and the signal pairs in rows 414-415. In the embodiment shown in FIG. 3A, arrangement of 36 contacts into columns can provide twelve differential signal pairs. Because the connector is devoid of shields, the contacts can be made relatively larger (compared to those in a connector having shields). Therefore, less connector space is needed to achieve the desired impedance.

Figure 3B:
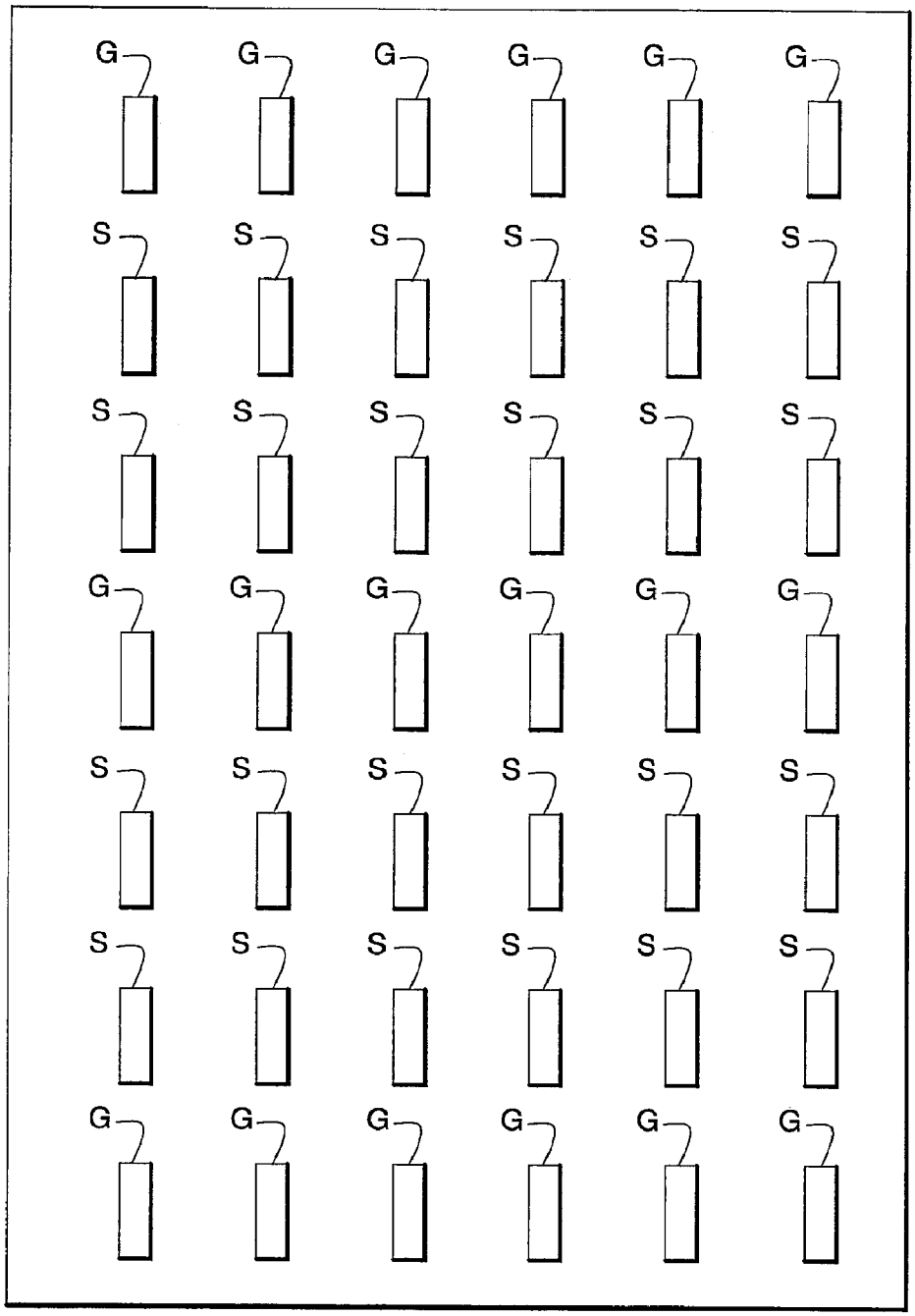
Figure 3C:
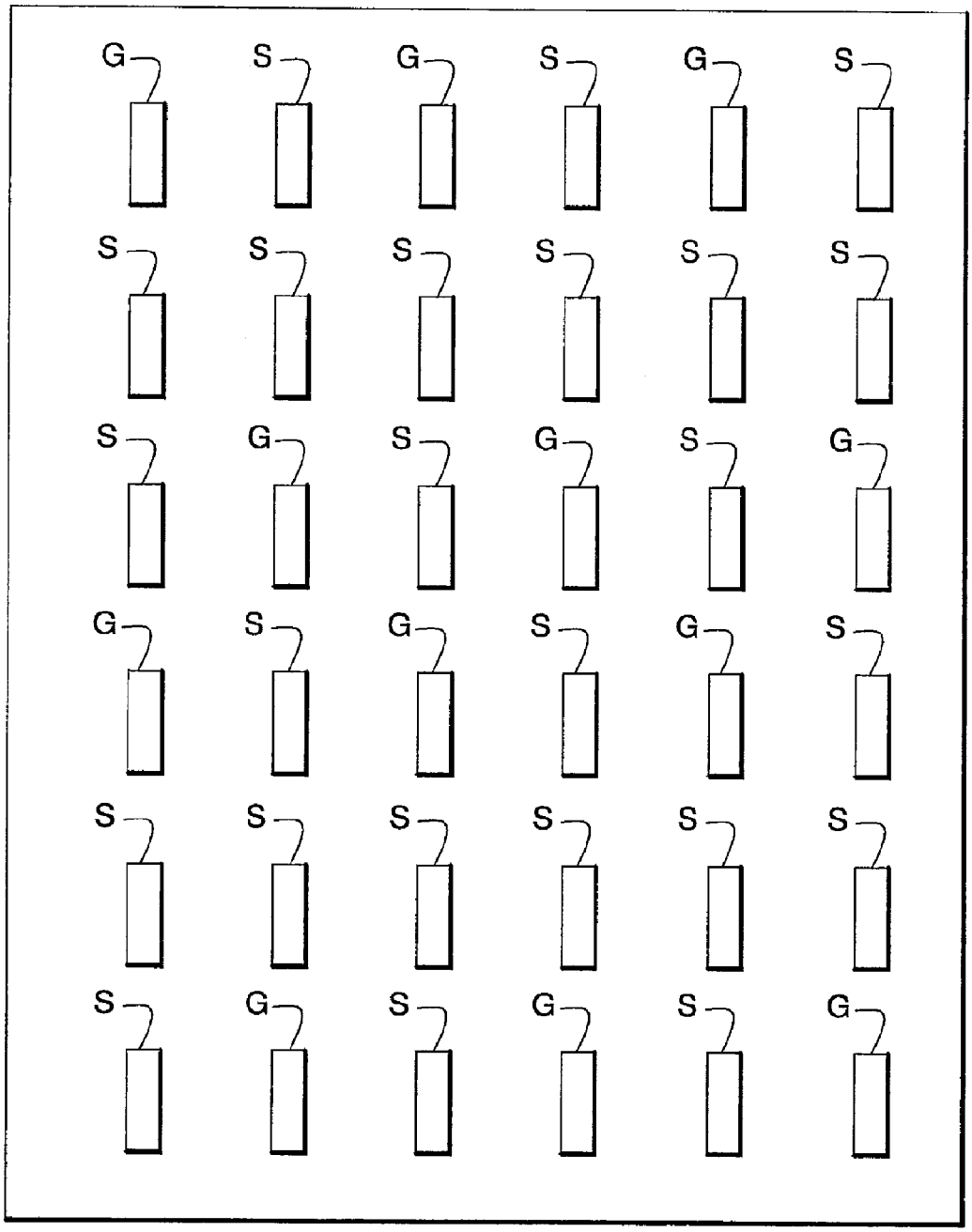

FIGS. 3B and 3C depict connectors according to the invention that include outer grounds. As shown in FIG. 3B, a ground contact G can be placed at each end of each column. As shown in FIG. 3C, a ground contact G can be placed at alternating ends of adjacent columns. It has been found that, in some connectors, placing outer grounds at alternating ends of adjacent columns increases signal contact density (relative to a connector in which outer grounds are placed at both ends of every column) without increasing the level of cross talk.

Figure 4:
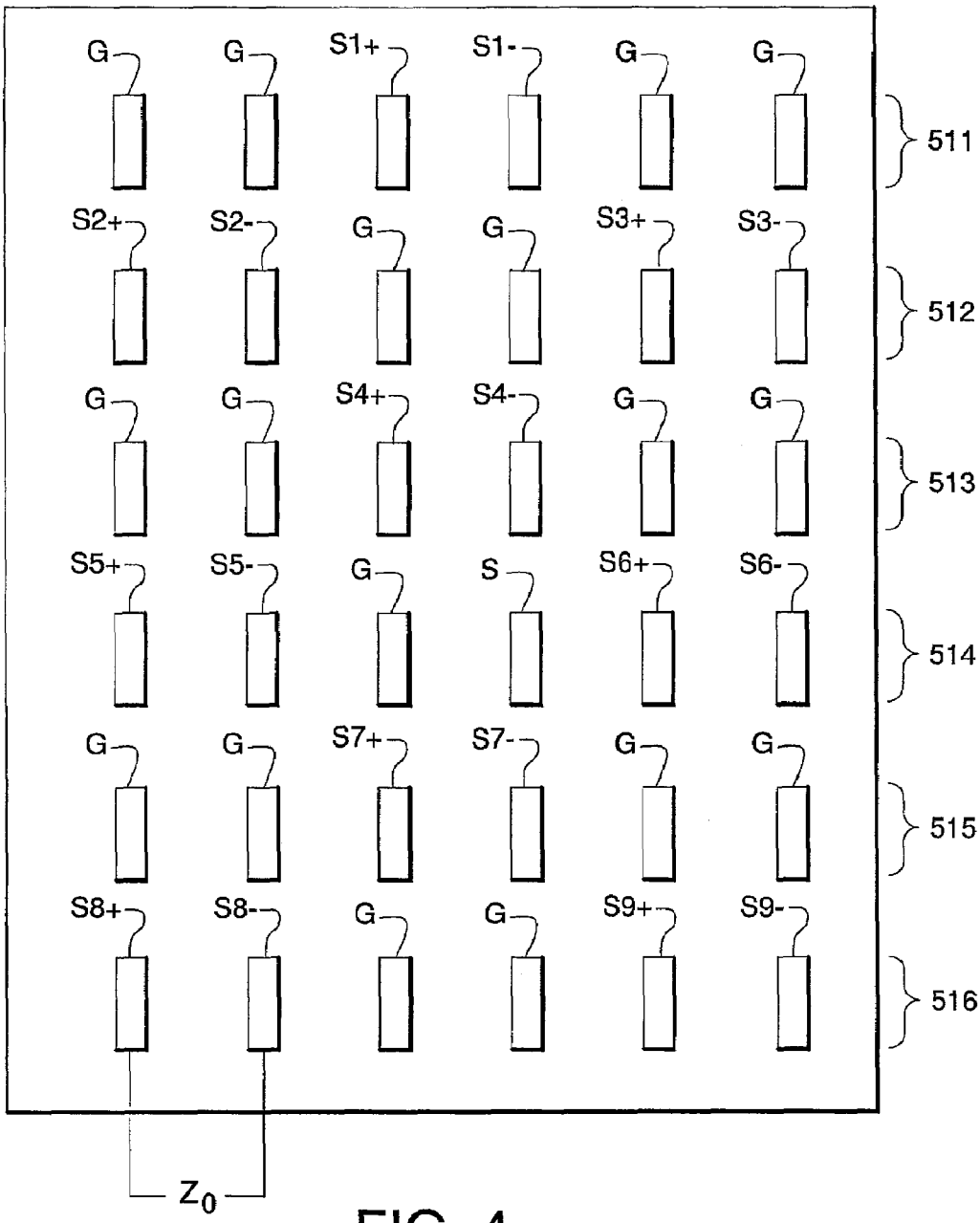
FIG. 4 depicts a conductor arrangement in which signal pairs are arranged in rows.

Alternatively, as shown in FIG. 4, differential signal pairs may be arranged into rows. As shown in FIG. 4, each row 511-516 comprises a repeating sequence of two ground conductors and a differential signal pair. First row 511 comprises, in order from left to right, two ground conductors G, a differential signal pair S1+, S1−, and two ground conductors G. Row 512 comprises in order from left to right, a differential signal pair S2+, S2−, two ground conductors G, and a differential signal pair S3+, S3−. The ground conductors block cross talk between adjacent signal pairs. In the embodiment shown in FIG. 4, arrangement of 36 contacts into rows provides only nine differential signal pairs.

By comparison of the arrangement shown in FIG. 3A with the arrangement shown in FIG. 4, it can be understood that a column arrangement of differential signal pairs results in a higher density of signal contacts than does a row arrangement. Thus, it should be understood that, although arrangement of signal pairs into columns results in a higher contact density, arrangement of the signal pairs into columns or rows can be chosen for the particular application.

Regardless of whether the signal pairs are arranged into rows or columns, each differential signal pair has a differential impedance $Z_0$ between the positive conductor Sx+ and negative conductor Sx− of the differential signal pair. Differential impedance is defined as the impedance existing between two signal conductors of the same differential signal pair, at a particular point along the length of the differential signal pair. As is well known, it is desirable to control the differential impedance $Z_0$ to match the impedance of the electrical device(s) to which the connector is connected. Matching the differential impedance $Z_0$ to the impedance of electrical device minimizes signal reflection and/or system resonance that can limit overall system bandwidth. Furthermore, it is desirable to control the differential impedance $Z_0$ such that it is substantially constant along the length of the differential signal pair, i.e., such that each differential signal pair has a substantially consistent differential impedance profile.

The differential impedance profile can be controlled by the positioning of the signal and ground conductors. Specifically, differential impedance is determined by the proximity of an edge of signal conductor to an adjacent ground and by the gap between edges of signal conductors within a differential signal pair.

As shown in FIG. 3A, the differential signal pair comprising signal conductors S6+ and S6− is located adjacent to one ground conductor G in row 413. The differential signal pair comprising signal conductors S12+ and S12− is located adjacent to two ground conductors G, one in row 413 and one in row 416. Conventional connectors include two ground conductors adjacent to each differential signal pair to minimize impedance matching problems. Removing one of the ground conductors typically leads to impedance mismatches that reduce communications speed. However, the lack of one adjacent ground conductor can be compensated for by reducing the gap between the differential signal pair conductors with only one adjacent ground conductor.

It should be understood that, for single-ended signaling, single-ended impedance may also be controlled by positioning of the signal and ground conductors. Specifically, single-ended impedance may be determined by the gap between a single-ended signal conductor and an adjacent ground. Single-ended impedance may be defined as the impedance existing between a single-ended signal conductor and an adjacent ground, at a particular point along the length of a single-ended signal conductor.

To maintain acceptable differential impedance control for high bandwidth systems, it is desirable to control the gap between contacts to within a few thousandths of an inch. Gap variations beyond a few thousandths of an inch may cause unacceptable variation in the impedance profile; however, the acceptable variation is dependent on the speed desired, the error rate acceptable, and other design factors.

Figure 5:
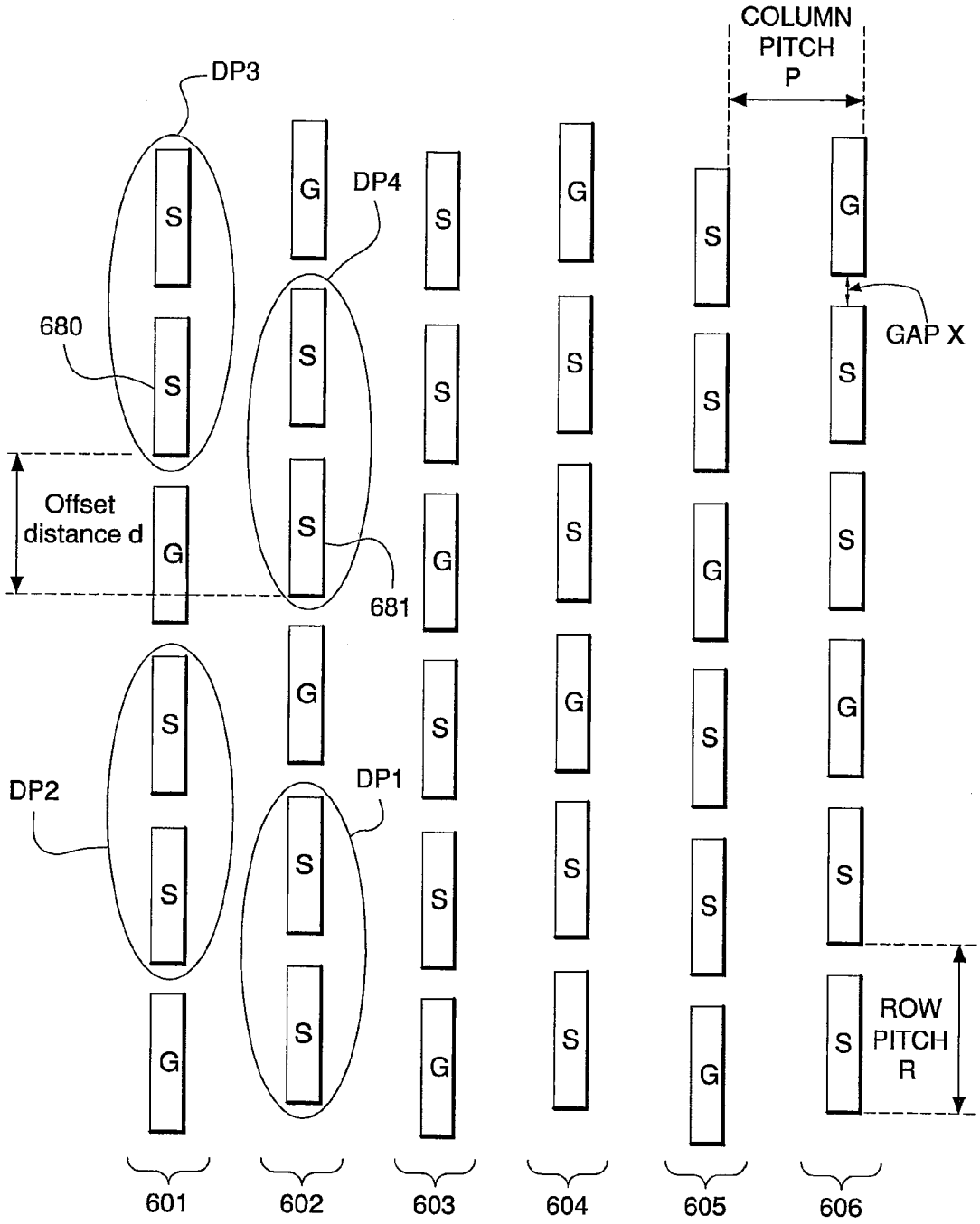
FIG. 5 is a diagram showing an array of six columns of terminals arranged in accordance with one aspect of the invention.

FIG. 5 shows an array of differential signal pairs and ground contacts in which each column of terminals is offset from each adjacent column. The offset is measured from an edge of a terminal to the same edge of the corresponding terminal in the adjacent column. The aspect ratio of column pitch to gap width, as shown in FIG. 5, is P/X. It has been found that an aspect ratio of about 5 (i.e., 2 mm column pitch; 0.4 mm gap width) is adequate to sufficiently limit cross talk where the columns are also staggered. Where the columns are not staggered, an aspect ratio of about 8-10 is desirable.

As described above, by offsetting the columns, the level of multi-active cross talk occurring in any particular terminal can be limited to a level that is acceptable for the particular connector application. As shown in FIG. 5, each column is offset from the adjacent column, in the direction along the columns, by a distance d. Specifically, column 601 is offset from column 602 by an offset distance d, column 602 is offset from column 603 by a distance d, and so forth. Since each column is offset from the adjacent column, each terminal is offset from an adjacent terminal in an adjacent column. For example, signal contact 680 in differential pair DP3 is offset from signal contact 681 in differential pair DP4 by a distance d as shown.

Figure 6A:
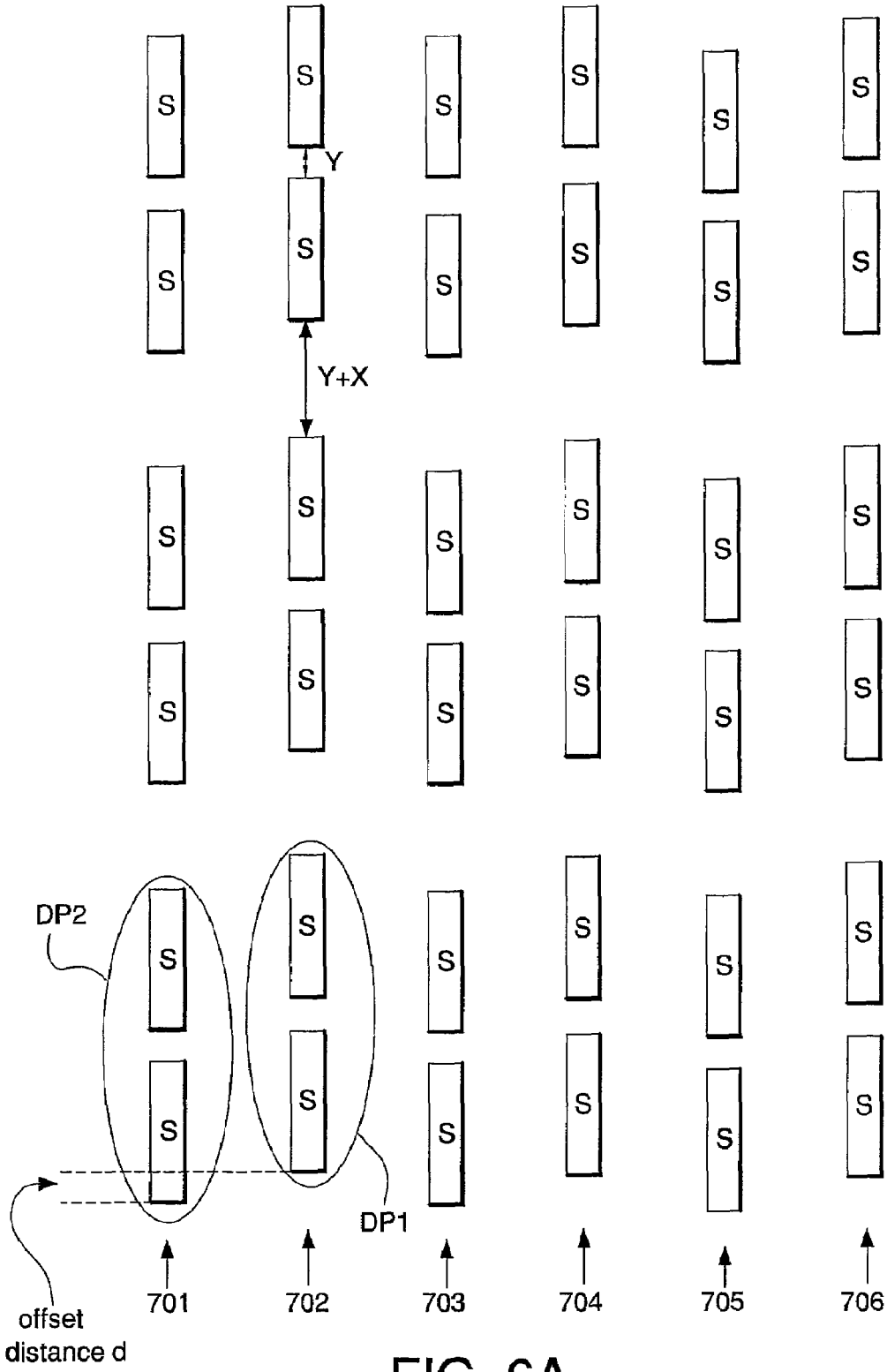
FIGS. 6A and 6B are diagrams showing contact arrangements in accordance with the invention wherein signal pairs are arranged in columns.
Figure 6B:
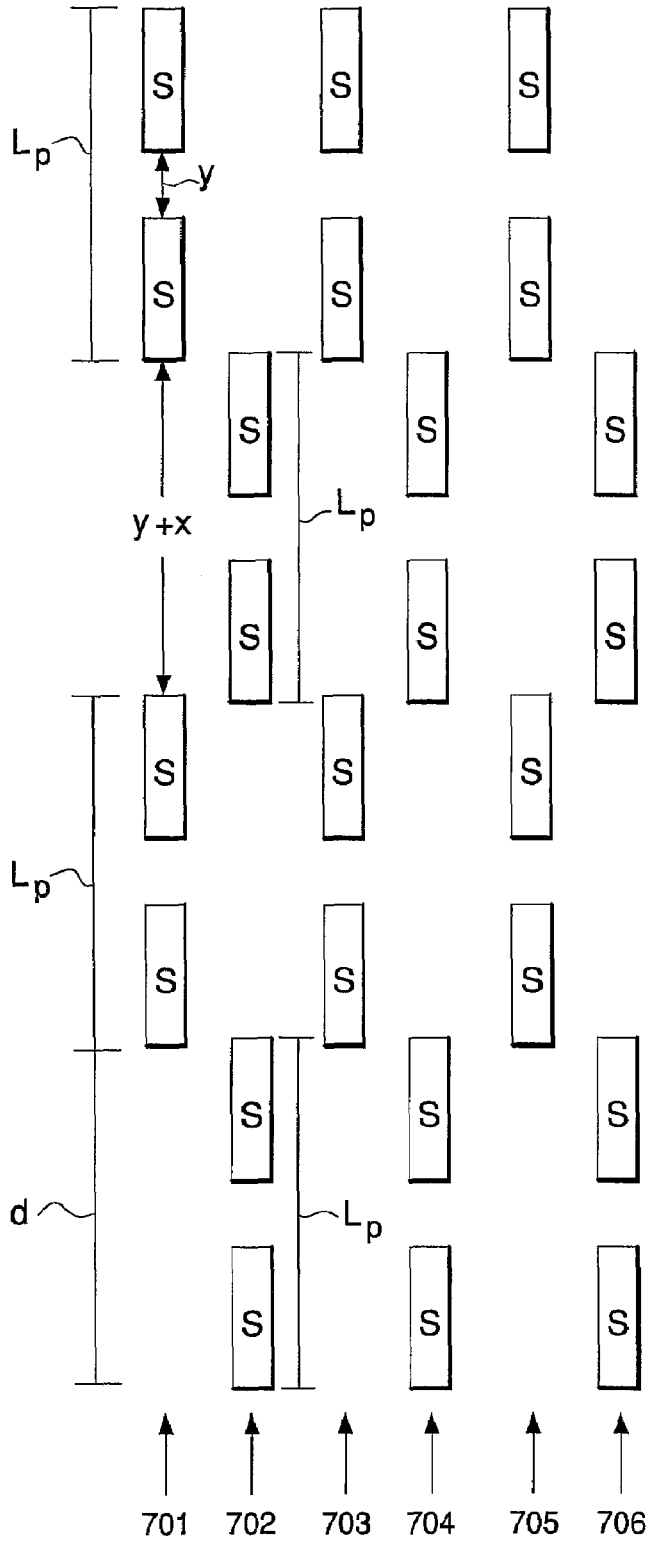

FIG. 6A illustrates another configuration of differential pairs wherein each column of terminals is offset relative to adjacent columns. For example, as shown, differential pair DP1 in column 702 is offset from differential pair DP2 in the adjacent column 701 by a distance d. In this embodiment, however, the array of terminals does not include ground contacts separating each differential pair. Rather, the differential pairs within each column are separated from each other by a distance greater than the distance separating one terminal in a differential pair from the second terminal in the same differential pair. For example, where the distance between terminals within each differential pair is Y, the distance separating differential pairs can be Y+X, where Y+X/Y>>1. It has been found that such spacing also serves to reduce cross talk. FIG. 6B depicts an example contact arrangement wherein adjacent rows are offset by a distance d that is nearly the length, $L_P$, of one signal pair. Also, the distance y+x between adjacent signal pairs within a column is also nearly one pair length $L_P$.

Exemplary Connector Systems According to the Invention

Figure 7:
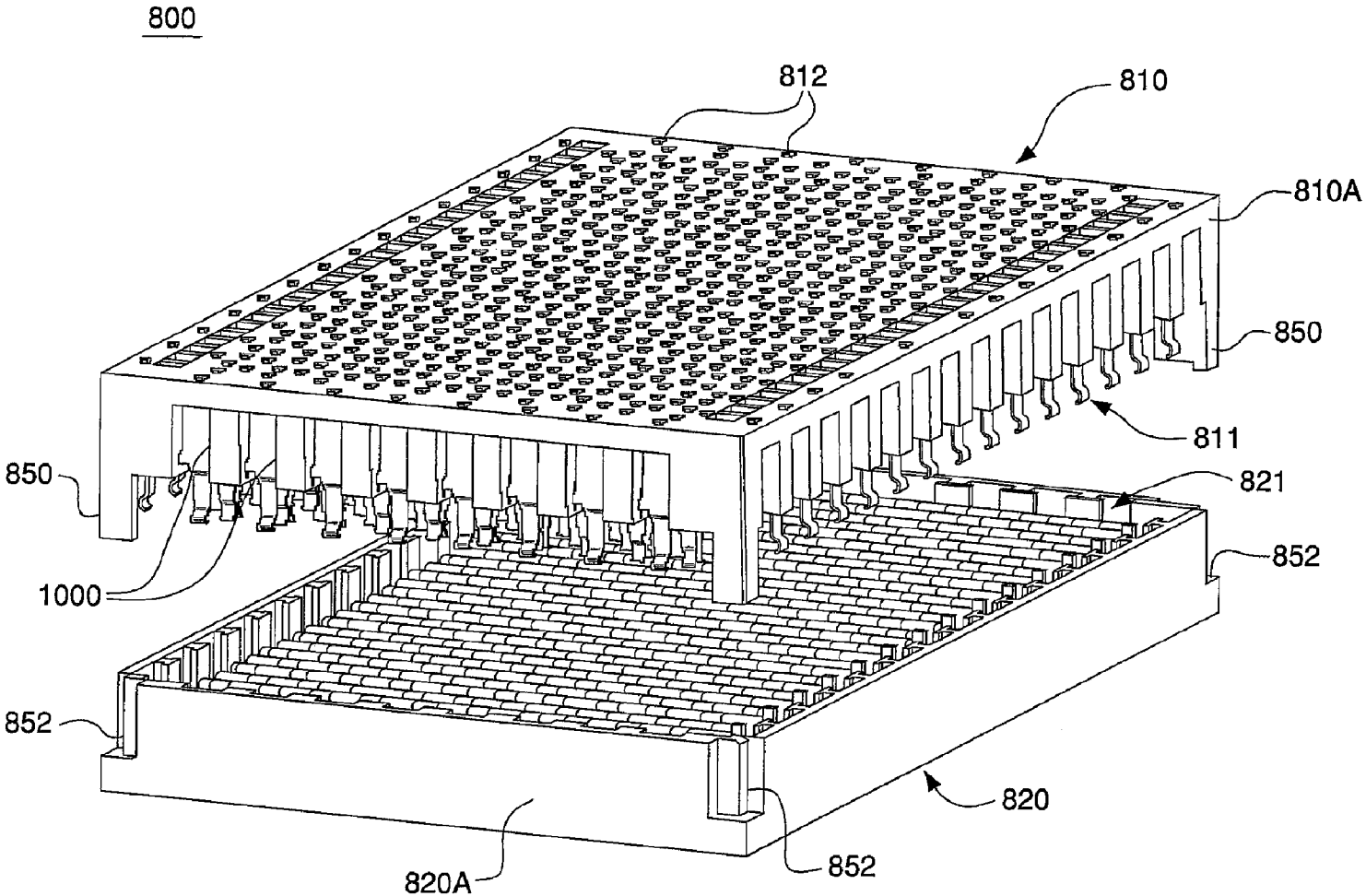
FIG. 7 is a perspective view of an exemplary mezzanine-style electrical connector having a header portion and a receptacle portion in accordance with an embodiment of the invention.

FIG. 7 shows a mezzanine-style connector according to the present invention. It will be appreciated that a mezzanine connector is a high-density stacking connector used for parallel connection of one electrical device such as, a printed circuit board, to another electrical device, such as another printed circuit board or the like. The mezzanine connector assembly 800 illustrated in FIG. 7 comprises a receptacle 810 and header 820.

In this manner, an electrical device electrically may mate with the receptacle portion 810 via apertures 812. Another electrical device electrically mates with the header portion 820 via ball contacts, for example. Consequently, once the header portion 820 and the receptacle portion 810 of connector 800 are electrically mated, the two electrical devices that are connected to the header and receptacle are also electrically mated via mezzanine connector 800. It should be appreciated that the electrical devices can mate with the connector 800 in any number of ways without departing from the principles of the present invention.

Receptacle 810 may include a receptacle housing 810A and a plurality of receptacle grounds 811 arranged around the perimeter of the receptacle housing 810A, and header 820 having a header housing 820A and a plurality of header grounds 821 arranged around the perimeter of the header housing 820A. The receptacle housing 810A and the header housing 820A may be made of any commercially suitable insulating material. The header grounds 821 and the receptacle grounds 811 serve to connect the ground reference of an electrical device that is connected to the header 820 with the ground reference of an electrical device that is connected to the receptacle 810. The header 820 also contains a plurality of header IMLAs (not individually labeled in FIG. 8 for clarity) and the receptacle 810 contains a plurality of receptacle IMLAs 1000.

Receptacle connector 810 may contain alignment pins 850. Alignment pins 850 mate with alignment sockets 852 found in header 820. The alignment pins 850 and alignment sockets 852 serve to align the header 820 and the receptacle 810 during mating. Further, the alignment pins 850 and alignment sockets 852 serve to reduce any lateral movement that may occur once the header 820 and receptacle 810 are mated. It should be appreciated that numerous ways to connect the header portion 820 and receptacle portion 810 may be used without departing from the principles of the invention.

Figure 8:
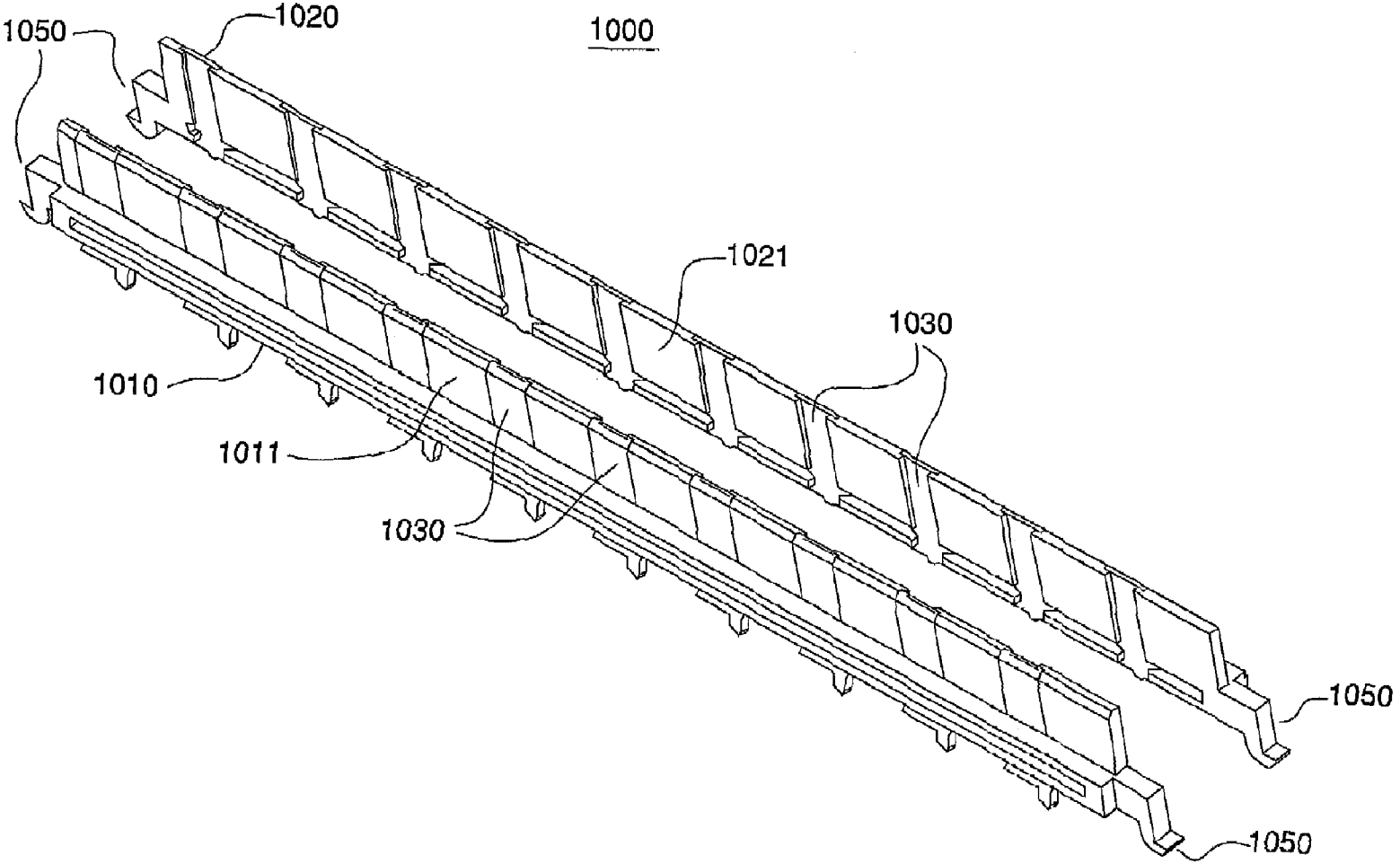
FIG. 8 is a perspective view of a header insert molded lead assembly pair in accordance with an embodiment of the invention.

FIG. 8 is a perspective view of a header IMLA pair in accordance with an embodiment of the invention. As shown in FIG. 8, the header IMLA pair 1000 comprises a header IMLA 1010 and a header IMLA 1020. IMLA 1010 comprises an overmolded housing 1011 and a series of header contacts 1030, and header IMLA 1020 comprises an overmolded housing 1021 and a series of header contacts 1030. As can be seen in FIG. 8, the header contacts 1030 are recessed into the housings of header IMLAs 1010 and 1020.

IMLA housing 1011 and 1021 may also include a latched tail 1050. Latched tail 1050 may be used to securely connect IMLA housing 1011 and 1021 in header portion 820 of mezzanine connector 800. It should be appreciated that any method of securing the IMLA pairs to the header 820 may be employed.

Figure 9:
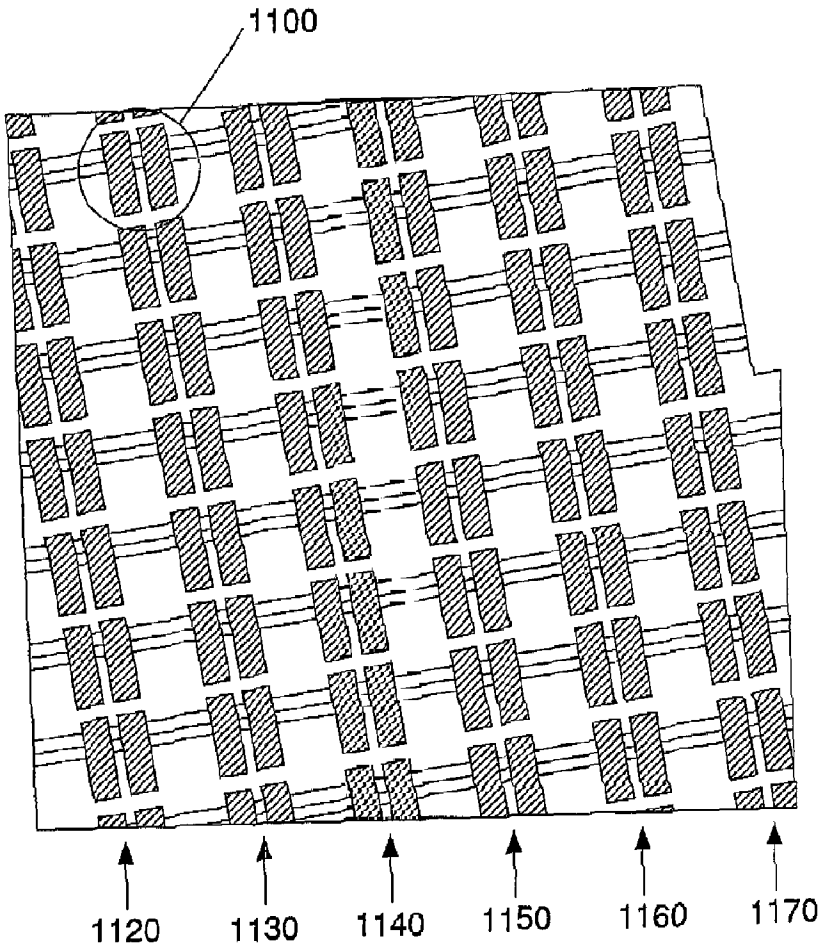
FIG. 9 is a top view of a plurality of header assembly pairs in accordance with an embodiment of the invention.

FIG. 9 is a top view of a plurality of header assembly pairs in accordance with an embodiment of the invention. In FIG. 9, a plurality of header signal pairs 1100 are shown. Specifically, the header signal pairs are arranged into linear arrays, or columns, 1120, 1130, 1140, 1150, 1160 and 1170. It should be appreciated that, as shown and in one embodiment of the invention, the header signal pairs are aligned and not staggered in relation to one another. It should also be appreciated that, as described above, the header assembly need not contain any ground contacts.

Figure 10:
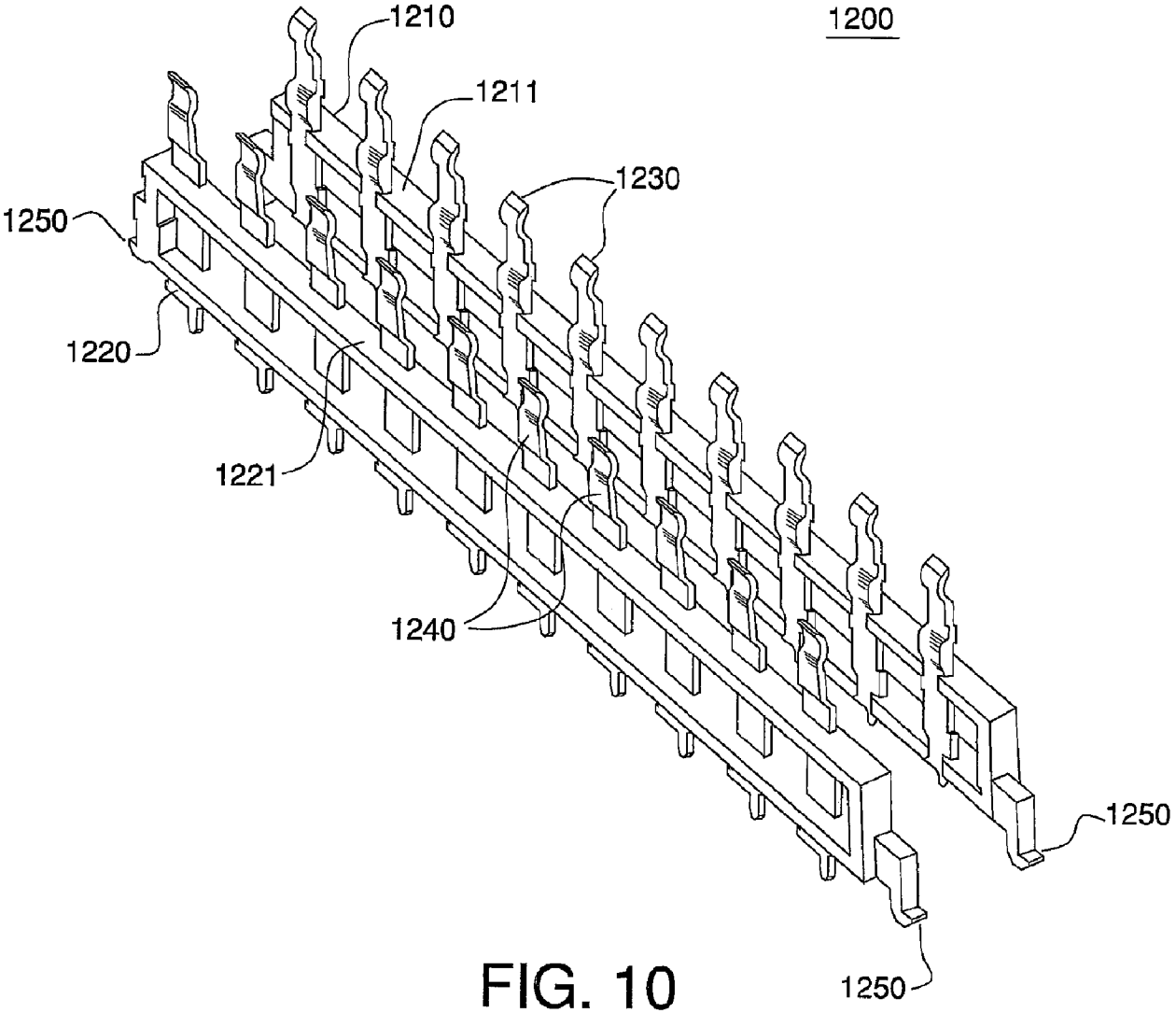
FIG. 10 is a perspective view of a receptacle insert molded lead assembly pair in accordance with an embodiment of the invention.

FIG. 10 is a perspective view of a receptacle IMLA pair in accordance with an embodiment of the invention. Receptacle IMLA pair 1200 comprises receptacle IMLA 1210 and receptacle IMLA 1220. Receptacle IMLA 1210 comprises an overmolded housing 1211 and a series of receptacle contacts 1230, and a receptacle IMLA 1220 comprises an overmolded housing 1221 and a series of receptacle contacts 1240. As can be seen in FIG. 10, the receptacle contacts 1240, 1230 are recessed into the housings of receptacle IMLAs 1210 and 1220. It will be appreciated that fabrication techniques permit the recesses in each portion of the IMLA 1210, 1220 to be sized very precisely. In accordance with one embodiment of the invention, the receptacle IMLA pair 1200 maybe devoid of any ground contacts.

IMLA housing 1211 and 1221 may also include a latched tail 1250. Latched tail 1250 may be used to securely connect IMLA housing 1211 and 1221 in receptacle portion 910 of connector 900. It should be appreciated that any method of securing the IMLA pairs to the header 920 may be employed.

Figure 11:
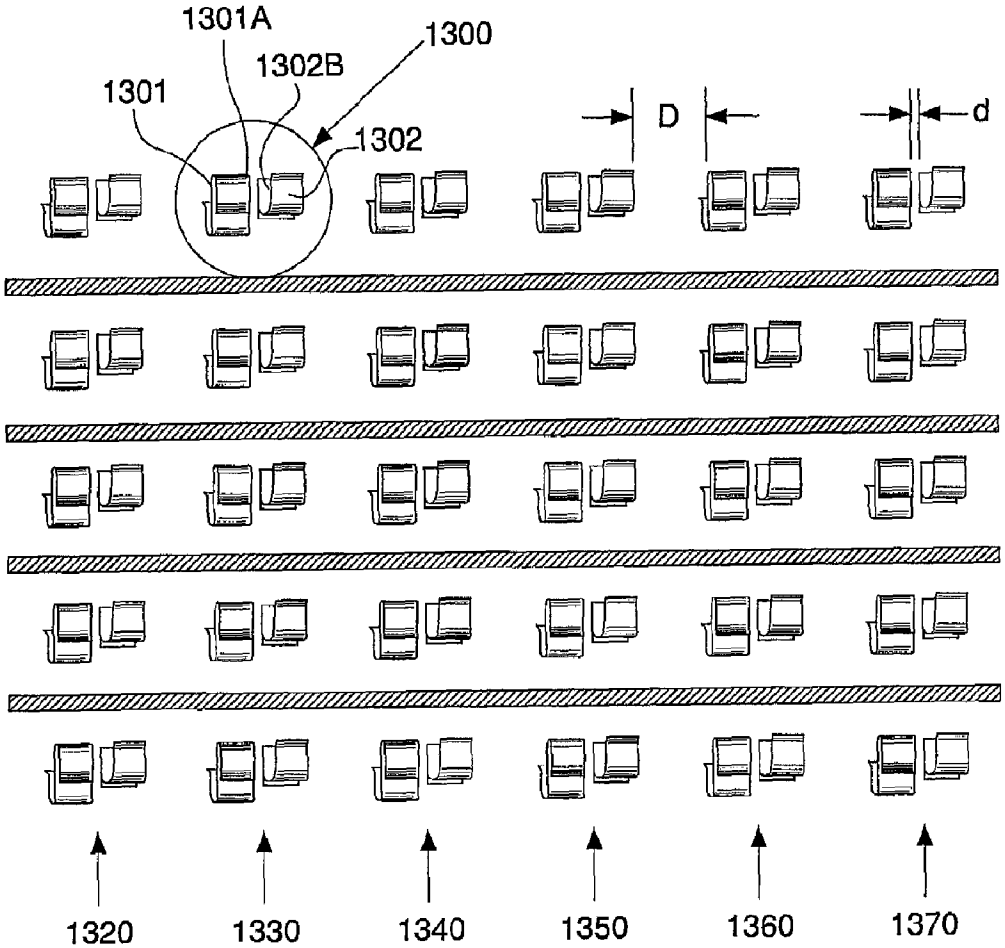
FIG. 11 is a top view of a plurality of receptacle assembly pairs in accordance with an embodiment of the invention.

FIG. 11 is a top view of a receptacle assembly in accordance with an embodiment of the invention. In FIG. 11, a plurality of receptacle signal pairs 1300 are shown. Receptacle pair 1300 comprises signal contacts 1301 and 1302. Specifically, the receptacle signal pairs 1300 are arranged in linear arrays, or columns, 1320, 1330, 1340, 1350, 1360 and 1370. It should be appreciated that, as shown and in one embodiment of the invention, the receptacle signal pairs are aligned and not staggered in relation to one another. It should also be appreciated that, as described above, the header assembly need not contain any ground contacts.

Also as shown in FIG. 11, the differential signal pairs are edge coupled. In other words, the edge 1301A of one contact 1301 is adjacent to the edge 1302A of an adjacent contact 1302B. Edge coupling also allows for smaller gap widths between adjacent connectors, and thus facilitates the achievement of desirable impedance levels in high contact density connectors without the need for contacts that are too small to perform adequately. Edge coupling also facilitates changing contact width, and therefore gap width, as the contact extends through dielectric regions, contact regions, etc.

As shown in FIG. 11, the distance D that separates the differential signal pairs relatively larger than the distance d, between the two signal contacts that make up a differential signal pair. Such relatively larger distance contributes to the decrease in the cross talk that may occur between the adjacent signal pairs.

Figure 12:
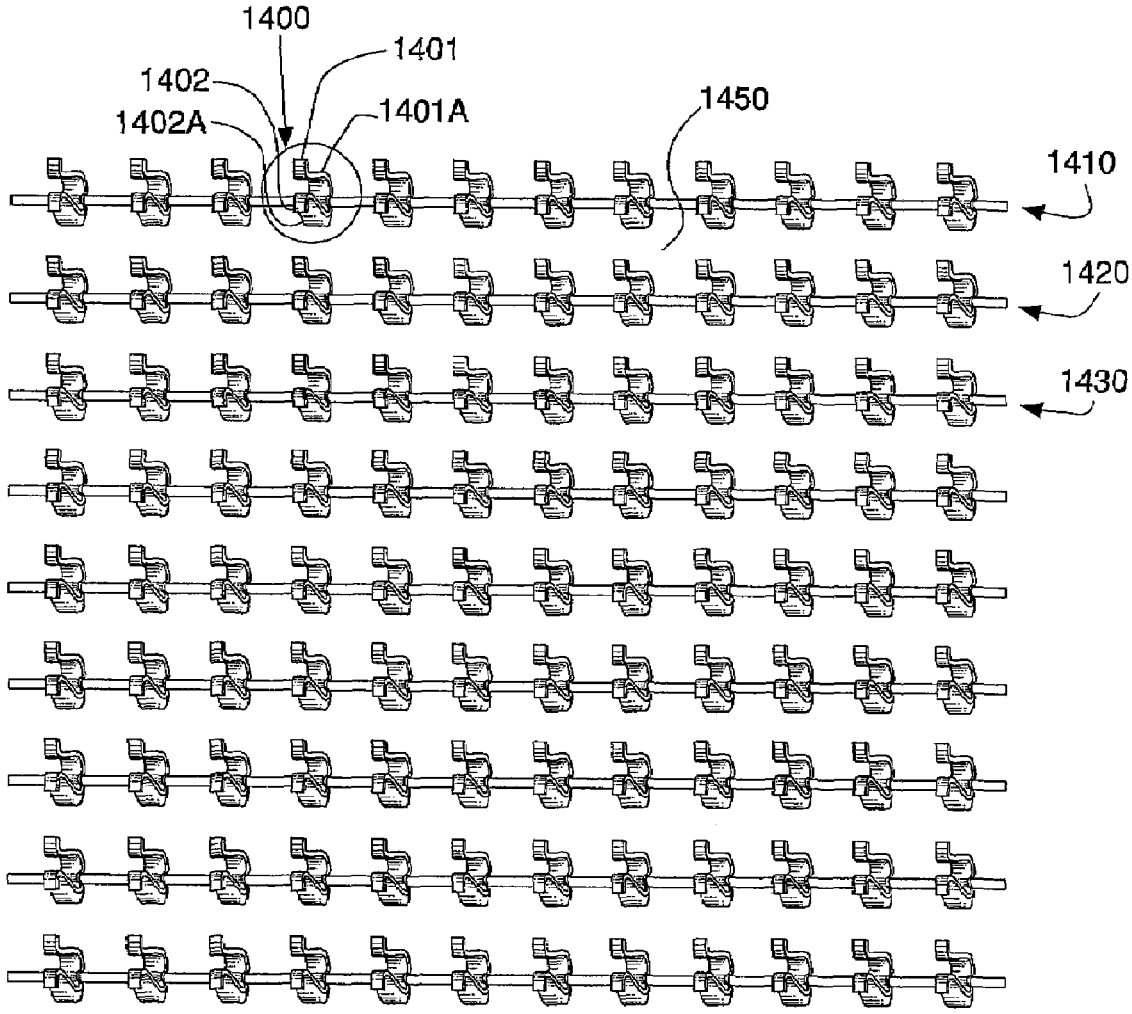
FIG. 12 is a top view of another plurality of receptacle assembly pairs in accordance with an embodiment of the invention.

FIG. 12 is a top view of another receptacle assembly in accordance with an embodiment of the invention. In FIG. 12, a plurality of receptacle signal pairs 1400 are shown. Receptacle signal pairs 1400 comprise signal contacts 1401 and 1402. As shown, the conductors in the receptacle portion are signal carrying conductors with no ground contacts present in the connector. Furthermore, signal pairs 1400 are broad-side coupled, i.e., where the broad side 1401A of one contact 1401 is adjacent to the broad side 1402A of an adjacent contact 1402 within the same pair 1400. The receptacle signal pairs 1400 are arranged in linear arrays or columns, such as, for example, columns 1410, 1420 and 1430. It should be appreciated that any number of arrays may be used.

In one embodiment of the invention, an air dielectric 1450 is present in the connector. Specifically, an air dielectric 1450 surrounds differential signal pairs 1400 and is between adjacent signal pairs. It should be appreciated that, as shown and in one embodiment of the invention, the receptacle signal pairs are aligned and not staggered in relation to one another.

Figure 13:
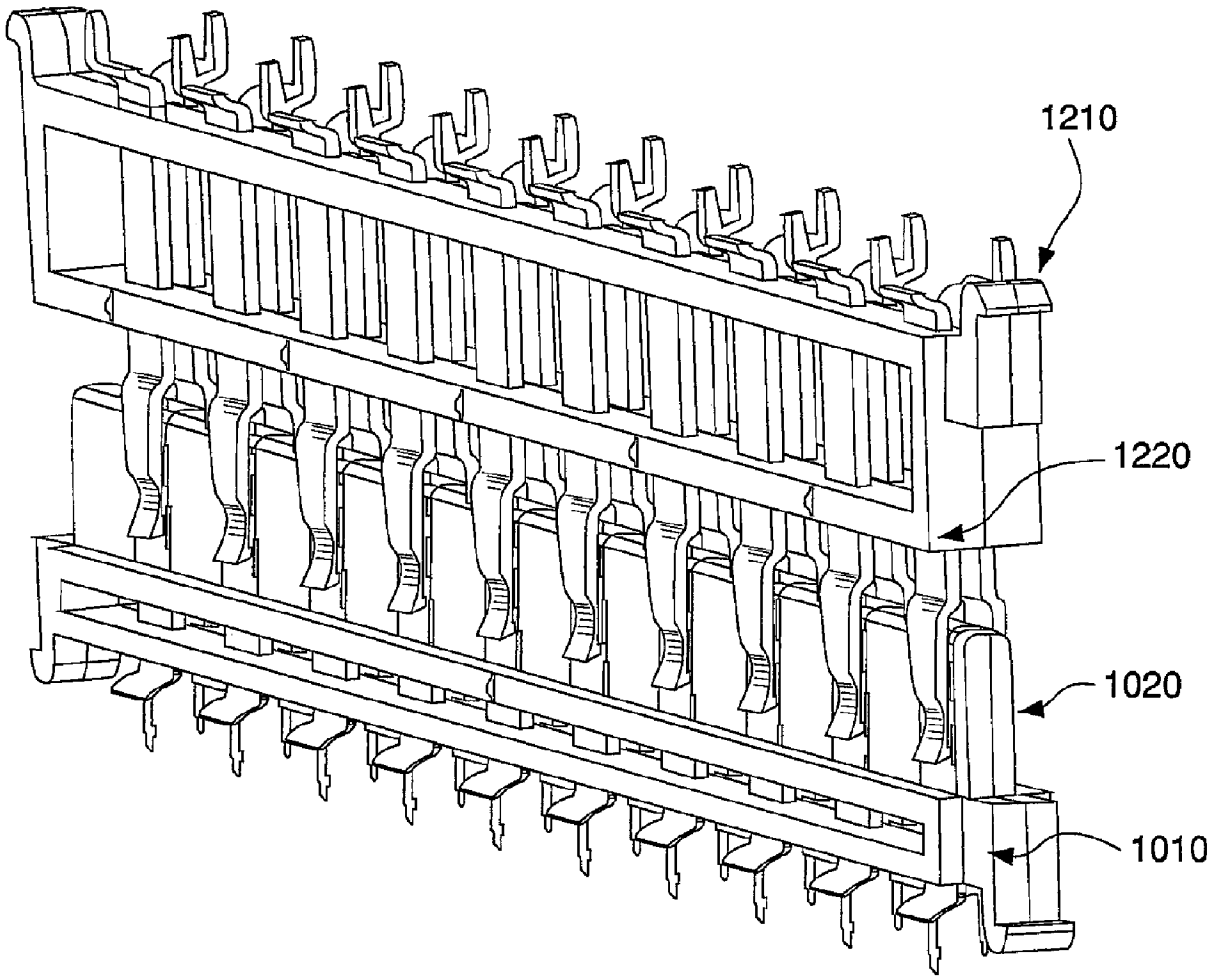
FIG. 13 is a perspective view of an operatively connected header and receptacle insert molded lead assembly pair in accordance with an embodiment of the invention.

FIG. 13 is a perspective view of a header and receptacle IMLA pair in accordance with an embodiment of the invention. In FIG. 13, a header and receptacle IMLA pair are in operative communications in accordance with an embodiment of the present invention. In FIG. 13, it can be seen that header IMLAs 1010 and 1020 are operatively coupled to form a single and complete header IMLA. Likewise, receptacle IMLAs 1210 and 1220 are operatively coupled to form a single and complete receptacle IMLA. FIG. 13 illustrates an interference fit between the contacts of the receptacle IMLA and the contacts of the header IMLA, it will be appreciated that any method of causing electrical contact, and/or for operatively coupling the header IMLA to the receptacle IMLA, is equally consistent with an embodiment of the present invention.

Figure 14A:
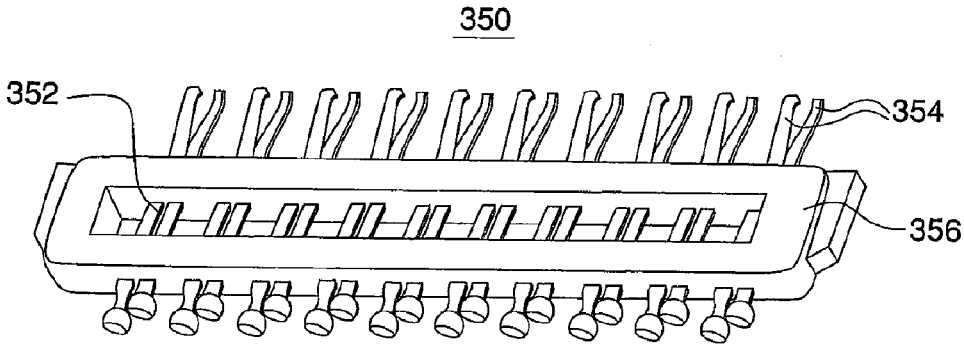
FIGS. 14A and 14B depict an alternate embodiment of an IMLA that may be used in a connector according to the invention.
Figure 14B:
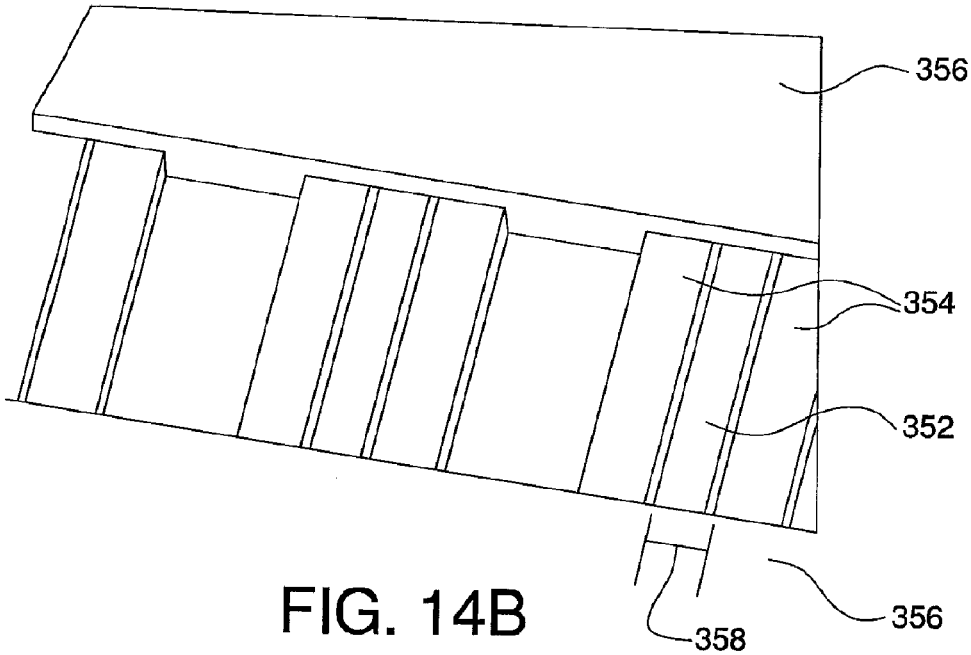

FIGS. 14A and 14B depict an alternate embodiment of an IMLA 350 that may be used in a connector according to the invention. As shown, a high-dielectric material 352 (i.e., a material having a relatively high permitivity, e.g., $2<\epsilon<4$, with $\epsilon\approx3.5$ being preferred) is disposed between the conductive leads 354 that form the differential signal pairs. Examples of high-dielectric materials that may be used include, but are not limited to, LCP, PPS, and nylon. The contacts 354 extend through and are fixed in an electrically insulating frame 356.

The presence of a high-dielectric material 352 between the conductors 354 permits a larger gap 358 between the conductors 354 for the same differential impedance as the pair would have in the absence of the high-dielectric material. For example, for a differential impedance of $Z_0=100\ \Omega$, a gap 358 of approximately 2 mm could be tolerated without the dielectric material. With the high-dielectric material 352 disposed between the conductors 354, a gap 358 of approximately 6 mm could be tolerated for the same differential impedance (i.e., $Z_0=100\ \Omega$). It should be understood that the larger gap between the conductors facilitates manufacturing of the connector.

Figure 15:
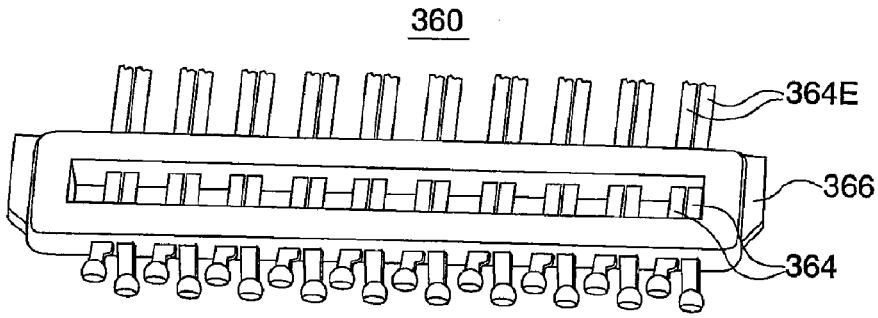
FIG. 15 depicts an embodiment of an IMLA wherein the contacts have relatively low spring movement.

FIG. 15 depicts an another alternate embodiment of an IMLA 360 for use in a connector according to the invention wherein the contacts have relatively low spring movement. That is, the free ends 364E of the contacts 364 are more rigid (and, as shown, may be generally straight and flat). Such contacts may be useful where it is desirable to minimize any springing action between the leads that form a signal pair. The contacts 364 extend through and are fixed in an electrically insulating frame 366.

Figure 16:
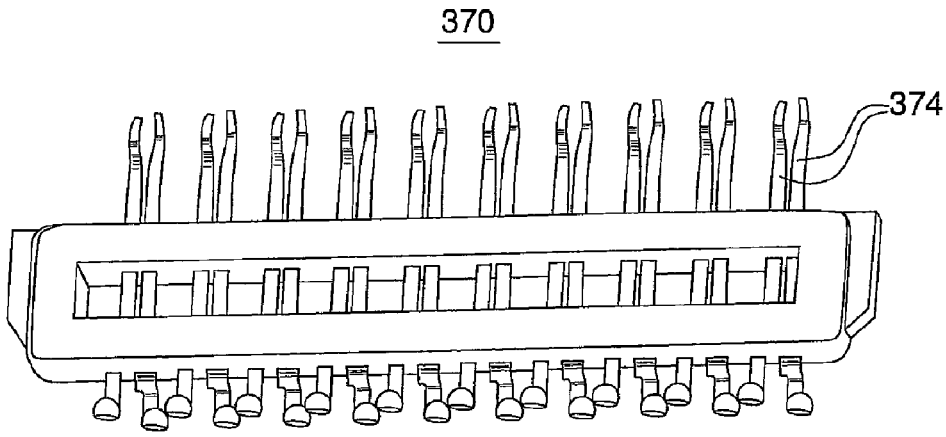
FIG. 16 depicts an embodiment of an IMLA having hermaphroditic contacts.

FIG. 16 depicts another alternate embodiment of an IMLA 370 according to the invention wherein the contacts 374 are single-beam hermaphroditic contacts. That is, each contact 374 is designed to mate to another contact having the same configuration (i.e., size and shape). Thus, in an embodiment of a connector that uses an IMLA such as depicted in FIG. 16, both portions of the connector may use the same contact.

Figure 17A:
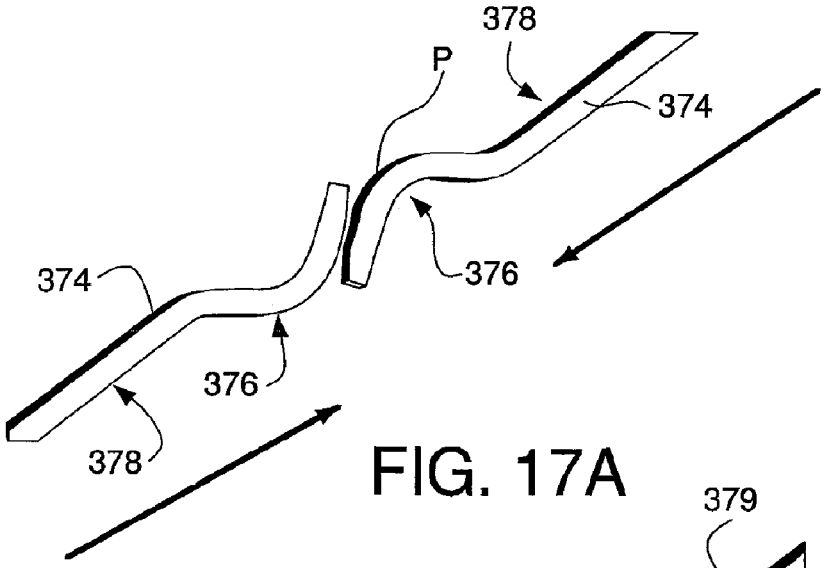
FIGS. 17A and 17B depict the mating details of an hermaphroditic contact.
Figure 17B:
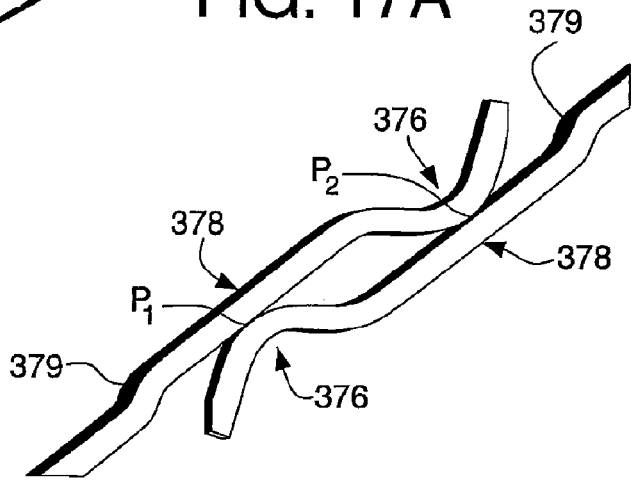

The mating details of an hermaphroditic contact 374 are shown in FIGS. 17A and 17B. Each contact 374 has a generally curved mating end 376 and a beam portion 378. As shown in FIG. 17A, as the contacts 374 begin to engage, there is one point of contact P. As mating is achieved, the contacts 374 deflect around the curved geometry of the mating end 376. As shown in FIG. 17B, there are two points of contact P1, P2 when the contacts 374 are mated. The contacts 374 resist un-mating by virtue of the curved geometry of the mating ends 376 and the resultant normal force between the contacts. Preferably, each contact 374 includes a curved resistance portion 379 to impede any desire by the contacts 374 to move too far in the mating direction.

It is to be understood that the foregoing illustrative embodiments have been provided merely for the purpose of explanation and are in no way to be construed as limiting of the invention. Words which have been used herein are words of description and illustration, rather than words of limitation. Further, although the invention has been described herein with reference to particular structure, materials and/or embodiments, the invention is not intended to be limited to the particulars disclosed herein. Rather, the invention extends to all functionally equivalent structures, methods and uses, such as are within the scope of the appended claims. Those skilled in the art, having the benefit of the teachings of this specification, may affect numerous modifications thereto and changes may be made without departing from the scope and spirit of the invention in its aspects.

What is claimed:

1. An electrical connector, comprising:

a mezzanine-style connector housing that defines a connector mating plane and a connector mounting plane that is parallel to the connector mating plane;

a first column of electrical contacts contained in the connector housing, the first column comprising a first arrangement of differential signal pairs separated from one another by first ground contacts;

a second column of electrical contacts contained in the connector housing, the second column comprising a second arrangement of differential signal pairs separated from one another by second ground contacts, wherein one differential signal pair in the second arrangement of differential signal pairs is a victim differential signal pair; and a third column of electrical contacts contained in the connector housing, the third column comprising a third arrangement of differential signal pairs separated from one another by third ground contacts, wherein (i) the second column is adjacent to the first column, and the third column is adjacent to the second column; (ii) the connector is devoid of electrical shields between the first column and the second column, and between the second column and the third column; (iii) the contacts in the first column are spaced apart from the contacts in the second column by a column-spacing distance of about 1.8-2.0 millimeters, and the contacts in the second column are spaced apart from the contacts in the third column by the column-spacing distance; (iv) each of the differential signal pairs defines a gap distance between the electrical contacts that form the pair; and (v) the gap distance relative to the column-spacing distance is such that differential signals with rise times of 200 picoseconds in the six differential signal pairs in the first, second, and third columns that are closest to the victim pair produce no more than 6% worst-case, multi-active cross talk on the victim differential signal pair.

2. The electrical connector as claimed in claim 1, wherein each differential signal pair comprises two electrical signal contacts that are tightly electrically coupled to one another.

3. The electrical connector as claimed in claim 1, wherein a differential signal pair in the third column is offset from the victim differential signal pair by a row pitch.

4. The electrical connector as claimed in claim 1, wherein a differential signal pair in the third column is offset from the victim differential signal pair by an offset distance that is less than a row pitch.

5. The electrical connector as claimed in claim 1, wherein a differential signal pair in the third column is offset from the victim differential signal pair by more than a row pitch.

6. The electrical connector as claimed in claim 1, wherein the impedance of the first differential signal pair is between about 90 and 110 Ohms.

7. The electrical connector as claimed in claim 1, wherein the 200 picosecond rise time represents a data transfer rate greater than 1.25 Gigabits/sec and less than 2.5 Gigabits/sec.

8. The electrical connector as claimed in claim 1, wherein electrical contacts that form a differential signal pair in the first column extend from a mating face of the connector and one of the first ground contacts extend farther from the mating face than the electrical contacts.

9. The electrical connector as claimed in claim 1, wherein electrical contacts that form a differential pair in the first column each terminate at a respective end thereof with a corresponding fusible mounting element.

10. The electrical connector as claimed in claim 1, wherein the worst-case, multi-active cross talk on the victim differential signal pair is 4% or less.

11. The electrical connector as claimed in claim 1, wherein the worst-case, multi-active cross talk on the victim differential signal pair is 3% or less.

12. The electrical connector as claimed in claim 1, wherein the electrical connector has an insertion loss of less than about 0.7 dB at 5 GHz.

13. The electrical connector as claimed in claim 1, wherein the differential signal pairs are broadside coupled.

14. The electrical connector as claimed in claim 1, wherein the gap distance relative to the column-spacing distance is such that differential signals with rise times of 150 picoseconds in the six differential signal pairs in the first, second, and third columns that are closest to the victim pair produce no more than 6% worst-case cross talk on the victim differential signal pair.

15. The electrical connector as claimed in claim 14, wherein the 150 picosecond rise time represents a data transfer rate of about 2.5 Gigabits/sec.

16. The electrical connector as claimed in claim 1, wherein the gap distance relative to the column-spacing distance is such that differential signals with rise times of 100 picoseconds in the six differential signal pairs in the first, second, and third columns that are closest to the victim pair produce no more than 6% worst-case cross talk on the victim differential signal pair.

17. The electrical connector as claimed in claim 16, wherein the 100 picosecond rise time represents a data transfer rate of about 3.2 Gigabits/sec.

18. The electrical connector as claimed in claim 1, wherein the gap distance relative to the column-spacing distance is such that differential signals with rise times of 50 picoseconds in the six differential signal pairs in the first, second, and third columns that are closest to the victim pair produce no more than 6% worst-case cross talk on the victim differential signal pair.

19. The electrical connector as claimed in claim 18, wherein the 50 picosecond rise time represents a data transfer rate greater than 4.8 Gigabits/sec and less than 10 Gigabits/sec.

20. The electrical connector as claimed in claim 1, wherein the gap distance relative to the column-spacing distance is such that differential signals with rise times of 40 picoseconds in the six differential signal pairs in the first, second, and third columns that are closest to the victim pair produce no more than 6% worst-case cross talk on the victim differential signal pair.

21. The electrical connector as claimed in claim 20, wherein the 40 picosecond rise time represents a data transfer rate of about 10 Gigabits/sec.

22. An electrical connector comprising:

a mezzanine-style connector housing that defines a connector mating plane and a connector mounting plane that is parallel to the connector mating plane;

a first column of electrical contacts contained in the connector housing, the first column comprising a first differential signal pair of electrical contacts, a first ground contact adjacent to the first differential signal pair, a second differential signal pair of electrical contacts adjacent to the first ground contact, a second ground contact adjacent to the second differential signal pair, and a third differential signal pair of electrical contacts adjacent to the second ground contact;

a second column of electrical contacts contained in the connector housing, the second column comprising a fourth differential signal pair of electrical contacts, a third ground contact adjacent to the fourth differential signal pair, a fifth differential signal pair of electrical contacts adjacent to the third ground contact, a fourth ground contact adjacent to the fifth differential signal pair, and a sixth differential signal pair of electrical contacts adjacent to the fourth ground contact; and a third column of electrical contacts contained in the connector housing, the third column comprising a seventh differential signal pair of electrical contacts, a fifth ground contact adjacent to the seventh differential signal pair, an eighth differential signal pair of electrical contacts adjacent to the fifth ground contact, a sixth ground contact adjacent to the eighth differential signal pair, and a ninth differential signal pair of electrical contacts adjacent to the sixth ground contact, wherein (i) the second column of electrical contacts is adjacent to the first column of electrical contacts and the third column of electrical contacts; (ii) the connector is devoid of electrical shields between the first, second, and third columns; (iii) the electrical contacts in the first column are spaced apart from the electrical contacts in the second column by a column-spacing distance, and the contacts in the second column are spaced apart from the contacts in the third column by the column-spacing distance; (iv) the electrical contacts that comprise the first differential signal pair are spaced apart by a gap distance that is less than the column-spacing distance; and (v) differential signals with rise times of 40 picoseconds in the six differential signal pairs in the first, second, and third columns that are closest to the fifth differential signal pair produce no more than 6% worst-case, multi-active cross talk on the fifth differential signal pair.

23. The electrical connector as claimed in claim 22, wherein electrical signal contacts in the first differential signal pair are tightly electrically coupled to each other.

24. The electrical connector as claimed in claim 22, wherein the fourth differential signal pair is offset from the first differential signal pair by a row pitch.

25. The electrical connector as claimed in claim 22, wherein the fourth differential signal pair is offset from the first differential signal pair by an offset distance that is less than a row pitch.

26. The electrical connector as claimed in claim 22, wherein the fourth differential signal pair is offset from the first differential signal pair by more than a row pitch.

27. The electrical connector as claimed in claim 22, wherein the impedance of the first differential signal pair is between about 90 and 110 Ohms.

28. The electrical connector as claimed in claim 22, wherein the worst-case, multi-active, cross-talk on the fifth differential signal pair is 3% or less.

29. The electrical connector as claimed in claim 22, wherein the 40 picosecond rise time represents a data transfer rate of about 10 Gigabits/sec.

30. The electrical connector as claimed in claim 22, wherein electrical contacts that form a differential signal pair in the first column of the first connector extend from a mating face of the first electrical connector and one of the first ground contacts extends farther from the mating face than the electrical contacts.

31. The electrical connector as claimed in claim 22, wherein electrical contacts that form the first differential signal pair each terminate at a respective end thereof with a corresponding fusible mounting element.

32. The electrical connector as claimed in claim 22, wherein worst-case, multi-active cross talk on the fifth differential signal pair is 4% or less.

33. The electrical connector as claimed in claim 22, wherein worst-case, multi-active cross talk on the fifth differential signal pair is 3% or less.

34. The electrical connector as claimed in claim 22, wherein the electrical connector has an insertion loss of less than about 0.7 dB at 5 GHz.

35. The electrical connector as claimed in claim 22, wherein the differential signal pairs are broadside coupled.

36. The electrical connector as claimed in claim 22, wherein differential signals with rise times of 200 picoseconds in each of the six closest differential signal pairs produce no more than 6% worst-case, multi-active cross talk on the fifth differential signal pair.

37. The electrical connector as claimed in claim 36, wherein the 200 picosecond rise time represents a data transfer rate greater than 1.25 Gigabits/sec and less than 2.5 Gigabits/sec.

38. The electrical connector as claimed in claim 22, wherein differential signals with rise times of 150 picoseconds in each of the six closest differential signal pairs produce no more than 6% worst-case, multi-active cross talk on the fifth differential signal pair.

39. The electrical connector as claimed in claim 38, wherein the 150 picosecond rise time represents a data transfer rate of about 2.5 Gigabits/sec.

40. The electrical connector as claimed in claim 22, wherein differential signals with rise times of 100 picoseconds in each of the six closest differential signal pairs produce no more than 6% worst-case, multi-active cross talk on the fifth differential signal pair.

41. The electrical connector as claimed in claim 40, wherein the 100 picosecond rise time represents a data transfer rate of about 3.2 Gigabits/sec.

42. The electrical connector as claimed in claim 22, wherein differential signals with rise times of 50 picoseconds in each of the six closest differential signal pairs produce no more than 6% worst-case, multi-active cross talk on the fifth differential signal pair.

43. The electrical connector as claimed in claim 42, wherein the 50 picosecond rise time represents a data transfer rate greater than 4.8 Gigabits/sec and less than 10 Gigabits/sec.

44. An electrical connector comprising:

a mezzanine-style connector housing that defines a connector mating plane and a connector mounting plane that is parallel to the connector mating plane;

a first column of electrical contacts contained in the connector housing, the first column comprising a first arrangement of differential signal pairs each separated from one another by first ground contacts;

a second column of electrical contacts contained in the connector housing, the second column comprising a second arrangement of differential signal pairs each separated from one another by second ground contacts, wherein one differential signal pair in the second arrangement of differential signal pairs is a victim pair; and a third column of electrical contacts contained in the connector housing, the third column comprising a third arrangement of differential signal pairs each separated from one another by third ground contacts, wherein (i) the second column is adjacent to the first column, and the third column is adjacent to the second column; (ii) the connector is devoid of electrical shields between the first column and the second column, and between the second column and the third column; (iii) the first column, the second column, and the third column are evenly spaced apart from one another by an equal column-spacing distance of about 1.8 to 2 millimeters; (iv) each of the differential signal pairs defines a gap distance between electrical contacts that form each differential signal pair; and (v) the gap distance relative to the column-spacing distance is such that differential signals with rise times of 40 picoseconds in the six differential signal pairs in the first, second, and third columns that are closest to the victim pair produce no more than an acceptable level of worst-case, multi-active cross talk on the victim pair.

45. The electrical connector as claimed in claim 44, wherein the gap distance is approximately 0.3 to 0.4 millimeters.

46. The electrical connector as claimed in claim 44, wherein the gap distance is between approximately one-tenth of the column pitch and one-fifth of the column pitch.

47. The electrical connector as claimed in claim 44, wherein the gap distance is between approximately one-tenth of the column pitch and one-eighth of the column pitch.

48. The electrical connector as claimed in claim 44, wherein the gap distance is approximately one-fifth of the column pitch.

49. The electrical connector as claimed in claim 44, wherein the column pitch is approximately two millimeters and the gap distance is between approximately 0.3 millimeters and 0.4 millimeters.

50. The electrical connector as claimed in claim 44, wherein electrical contacts that form the first differential signal pair each terminate at a respective end thereof with a corresponding fusible mounting element.

51. The electrical connector as claimed in claim 44, wherein the impedance of the first differential signal pair is between about 90 and 110 Ohms.

52. The electrical connector as claimed in claim 44, wherein the first linear array is staggered relative to the second linear array.

53. The electrical connector as claimed in claim 44, wherein the differential signal pairs are broadside coupled.

* * * * *